US007111606B2

(12) United States Patent
Klassen

(10) Patent No.: US 7,111,606 B2
(45) Date of Patent: Sep. 26, 2006

(54) ROTARY POSITIVE DISPLACEMENT DEVICE

(76) Inventor: James B. Klassen, 2236 Cherry St., Lynden, WA (US) 98264

( * ) Notice: Subject to any disclaimer, the term of this patent is extended or adjusted under 35 U.S.C. 154(b) by 0 days.

(21) Appl. No.: 10/072,095

(22) Filed: Feb. 8, 2002

(65) Prior Publication Data

US 2003/0209221 A1 Nov. 13, 2003

Related U.S. Application Data

(60) Provisional application No. 60/267,969, filed on Feb. 8, 2001.

(51) Int. Cl.
*F02B 53/00* (2006.01)
*F01C 1/10* (2006.01)
*F04C 17/06* (2006.01)

(52) U.S. Cl. ..... 123/246; 123/204; 418/171; 418/170; 418/165

(58) Field of Classification Search ..... 123/246, 123/204; 418/170, 169, 165, 167, 171
See application file for complete search history.

(56) References Cited

U.S. PATENT DOCUMENTS

| | | | | |
|---|---|---|---|---|
| 294,026 A | | 2/1884 | Fitts | 418/206.1 |
| 295,597 A | | 3/1884 | Troutman | 418/206.5 |
| 726,896 A | * | 5/1903 | Franzen | 418/167 |
| 728,157 A | | 5/1903 | Box | 418/171 |
| 2,354,992 A | | 8/1944 | Gottlieb | 418/196 |
| 2,547,392 A | | 4/1951 | Hill et al. | 418/171 |
| 3,057,157 A | | 10/1962 | Close | 123/204 |
| 3,439,825 A | | 4/1969 | Warne | 418/190 |
| 3,802,813 A | | 4/1974 | Butler | 418/165 |
| 3,810,721 A | | 5/1974 | Eyer | 418/170 |
| 3,850,150 A | * | 11/1974 | Plevyak | 123/246 |
| 3,981,646 A | | 9/1976 | Bottoms | 418/190 |
| RE31,418 E | * | 10/1983 | Tschritter | 418/169 |
| 4,548,562 A | | 10/1985 | Hughson | 418/201.3 |
| 4,932,850 A | | 6/1990 | Valavaara | 418/171 |
| 5,299,923 A | | 4/1994 | Arbogast et al. | 418/171 |
| 5,522,536 A | | 6/1996 | Kallenberger | 228/175 |
| 5,577,899 A | | 11/1996 | Phillips | 418/206.1 |
| 5,658,138 A | | 8/1997 | Round et al. | 418/171 |
| 5,720,251 A | | 2/1998 | Round et al. | 123/246 |
| 5,842,848 A | | 12/1998 | Knowles | 418/196 |
| 6,123,533 A | | 9/2000 | McBurnett et al. | 418/91 |

FOREIGN PATENT DOCUMENTS

CH 258101 A 4/1949

(Continued)

OTHER PUBLICATIONS

International Search report for Application No. PCT/US 02/04096 (the PCT counterpart of the parent application) mailed Sep. 13, 2002.

*Primary Examiner*—Thai-Ba Trieu
(74) *Attorney, Agent, or Firm*—Knobbe, Martens, Olson & Bear, LLP.

(57) ABSTRACT

A device to convert energy having exterior and interior rotors where the number of legs (Λ) of an interior rotor divided by the number of chambers (X) defined by the fins of the outer rotor is equal to the effective radius of the inner reference circle $r_i$ divided by the effective radius of the outer reference circle $r_o$ (i.e. $\Lambda/X=r_i/r_o$). Where the surface of the fins of the outer rotor and the toe and heel portion of the interior rotor allow for a sealed chamber for a finite amount of rotation of the inner and outer rotors.

33 Claims, 24 Drawing Sheets

FOREIGN PATENT DOCUMENTS

| | | | | |
|---|---|---|---|---|
| DE | 2437259 | | 2/1976 | |
| DE | 2525335 | | 12/1976 | |
| DE | 2553421 | | 6/1977 | |
| DE | 2622145 | | 6/1977 | |
| DE | 3242431 | A1 | 5/1984 | ..... 123/204 |
| JP | 53-116506 | A | 10/1978 | |
| JP | 6-272672 | | 9/1994 | |
| JP | 6-272673 | | 9/1994 | |
| WO | WO 96/28641 | | 9/1996 | |
| WO | WO 99/61753 | | 12/1999 | |
| WO | WO 01/51770 | A1 | 7/2001 | |
| WO | WO 02/06635 | A1 | 1/2002 | |
| WO | WO 02/061274 | A1 | 8/2002 | |
| WO | WO 02/063140 | A3 | 8/2002 | |
| WO | WO 03/102420 | | 12/2003 | |

* cited by examiner

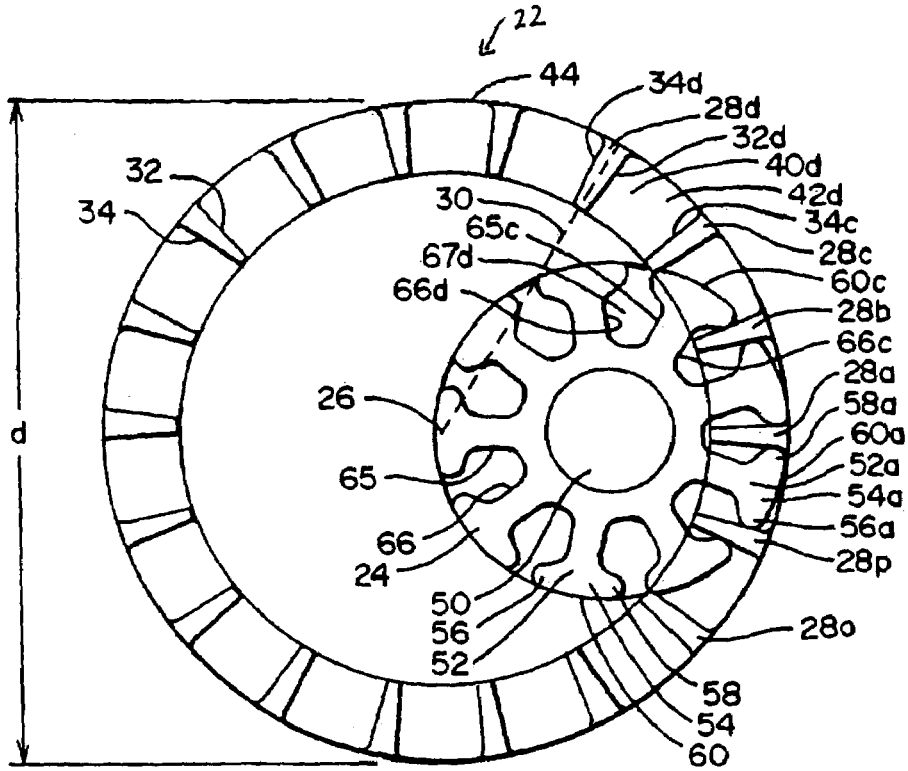
FIG. 2
FIG. 3
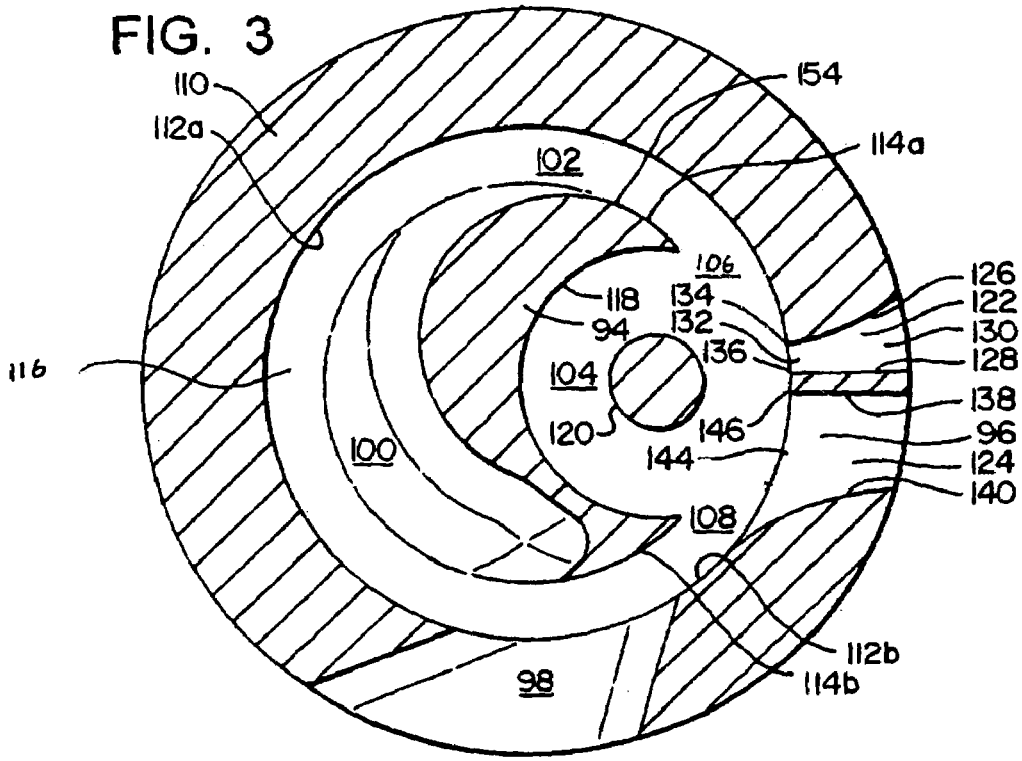

13/24

ROTARY POSITIVE DISPLACEMENT DEVICE

This application claims the benefit of priority from provisional application Ser. No. 60/267,969 filed Feb. 8, 2001, which application is incorporated by reference herein-in its entirety.

FIELD OF INVENTION

The invention relates to rotary motion positive displacement devices having interior rotors that have extensions that engage inner chamber regions of an outer rotor.

BACKGROUND

Reciprocating motion of piston engines and positive displacement compressors have mechanical limitations on their maximum rotations per minute due to the stresses and wear incurred by reciprocating motion. Other rotary motion positive displacement devices that have rotors on parallel axes of rotation such as shown in U.S. Pat. No. 3,850,150 employ a plurality of interior rotors, however, the spurs of the interior rotors are not adapted to engage either end of the recesses of the outer rotor simultaneously for more than a single point of rotation. Therefore it is not possible to have a sealed displacement chamber in the recesses of the outer rotor.

The disclosure of U.S. Pat. No. 726,896 discloses a positive displacement inner and outer rotor scheme that utilizes a geometry of 2 to 1 for the outer and inner effective radii. This results in linear walled chambers that are parallel to reference radii of the outer rotor. This is possible only with a 2 to 1 aspect ratio which is discussed thoroughly in the disclosure below. As discussed below in the preferred embodiment, a multi-interior rotor scheme with an outer effective radius of the outer rotor greater than twice the value of the effective radius of the inner rotors can not use a linear shaped surface arrangement on the outer rotors and the feet of the inner rotors.

Other references do not disclose a proper chamber tangential width that is a function of the radial distance. When the chamber walls of an outer rotor are parallel such as in U.S. Pat. No. 728,157 the pistons can not possibly maintain a seal for any duration of rotation where the aspect ratio of the outer and inner rotors is greater than 2 to 1 but is 37 to 15 (37 pressure chambers to 15 inner pistons. Alternatively, interference will occur when the circular member of the spade shaped pistons radially extend into the pressure chambers. As described herein such a converging surface of the chamber widths allows for a seal for more than a single point of rotation.

SUMMARY OF THE INVENTION

The invention includes a device to convert energy by displacing fluid having an outer rotor adapted to rotate about a first axis of rotation. The outer rotor has a plurality of fins each comprising a first surface and a second surface that partially define a chamber region interposed thereinbetween where a first fin and a second fin are members of the said plurality of fins and are adjacent to each other. The outer rotor also has a first reference radius extends through the first fin and a second reference radius extends through the second fin, a first surface of the said first fin is a first defined distance from the said first reference radius with respects to the radial location along the said first reference radius, and a second surface of the said second fin is a second defined distance from the said second reference radius with respects to the radial location along the said second reference radius, and the number of the chambers indicated by variable X. An outer reference dimension circle is concentric with the first axis of rotation of the outer rotor and the outer reference dimension circle having a radius $r_o$. The invention further has an inner rotor adapted to rotate about a second axis of rotation and the inner rotor comprising an inner reference circle that is concentric with the second axis of rotation and the inner reference circle intersecting the outer reference circle of the said outer rotor at an intersect point where the velocity of the inner rotor and outer rotor are the same at the intersect point, the inner reference circle having a radius $r_i$, the inner rotor further comprising a plurality of legs the number of said legs for each inner rotor is indicated by variable $\Lambda$. A first leg that is a member of said legs comprises a foot region having a heel region comprising a first reference point that is adapted to rotate with the inner reference circle where said first reference point is non constant perpendicular distance from the said first reference radius of the outer reference circle with respects to rotation of the inner and the outer rotor, and the heel region further comprising a first engagement surface that is a first defined distance from the said first point where the said first defined distance of the heel region and the first defined distance of the first surface of the said first fin are collinear and their sum is non constant with respects to rotation of the inner rotor and the outer rotor. The foot region further comprises a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor.

The invention further has a casing having an inner chamber region that is adapted to house said outer rotor and allow the outer rotor to rotate therein. The casing has a fluid entrance system comprising a duct to communicate with the chamber region of the said outer rotor, an interior cavity adapted to house the said inner rotors and allow the inner rotors to rotate therein.

Whereas the variables $\Lambda$, X, $r_i$, $r_o$ are constrained by the equation $\Lambda/X=r_i/r_o$. The foot region of the said first leg is adapted to engage the chamber region where the first engagement surface of said heel region engages the said first surface of a first fin and the said second engagement surface of the said toe region of the said first foot is adapted to engage the second surface of a second fin to form a sealed operating chamber where rotation of the said first rotor and the said rotor causes displacement of fluid in the sealed operating chamber.

The invention is particularly advantageous as a compressor that positively displaces the gas and in one embodiment the exit port location with respect to the housing is adjusted in order to decrease the pressure differential between an exit chamber and the exit pressure. By altering the porting the invention can be used as a pump to displace incompressible fluids.

The invention is further particularly advantageous when using as an external combustion engine where the compressed air is discharged from an exit chamber to a combustion chamber where the volume of gas is increased and a portion of the discharge gas is directed to the rotor assembly and the remaining volume of gas can be used for a "hot blow" or directed to a rotor assembly to induce a "cold blow" for usable energy. Alternatively, torque from the rotor assembly could be utilized for work output.

BRIEF DESCRIPTION OF THE DRAWINGS

FIG. 2 is a top view of an outer rotor and inner rotor;

FIG. 3 is a top view of a housing for the first embodiment;

FIG. 31 shows how the center points for the heel and toe arcs can extend beyond the inner reference circle.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 1:
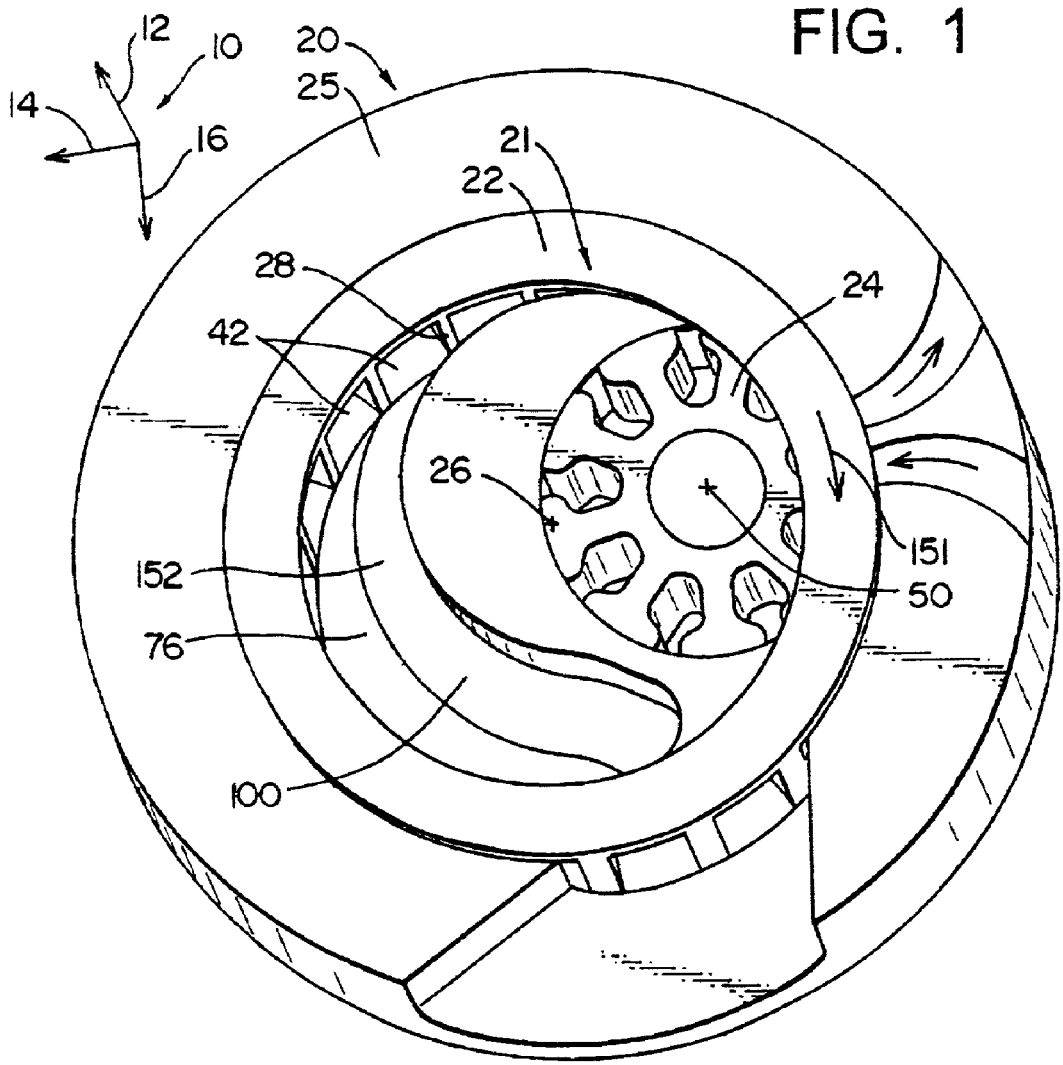
FIG. 1 is an isometric view of the first embodiment of the present invention.

To a description of the apparatus 20, an axis system 10 is defined as shown in FIG. 1 where the transverse axes is indicated by arrow 12, arrow 14 is referred to as the crossword axis and is aligned to pass through centerpoints 50 and 26. Finally, the axis orthogonal to both axes 12 and 14 are referred to as the wayward axis indicated by arrow 16.

The term fluid is defined as compressible and incompressible fluids as well as other particulate matter and mixtures that flows with respects to pressure differentials applied thereto. Displacing a fluid is defined as either compressing a fluid or transfer of an incompressible fluid from a high to low pressure location or allowing expansion of a fluid in a chamber. Engagement is defined as either having a fluid film or fluid film seal between two adjacent surfaces or be in contact or having interference between two surfaces where forceful contact occurs for a tight seal.

In the following text, there will first be a description of the first embodiment with a detailed description of the geometries necessary to prevent surface interference between the inner rotor 24 and the outer rotor 22. Thereafter there is a detailed description of a second embodiment where the rotor assembly 21 of the first embodiment is used in combination with an external combustion chamber to create an external combustion engine. Finally, there is a description of several other preferred embodiments that utilized numerous internal rotors, which have inner reference circles that are at a ratio of number of legs (Λ) divided by the number of chambers (X) defined by the fins is equal to the radius of the inner reference circle $r_i$ divided by the outer reference circle $r_o$ (i.e. $\Lambda/X=r_i/r_o$) and $r_i/r_o$ is <½.

Figure 10:
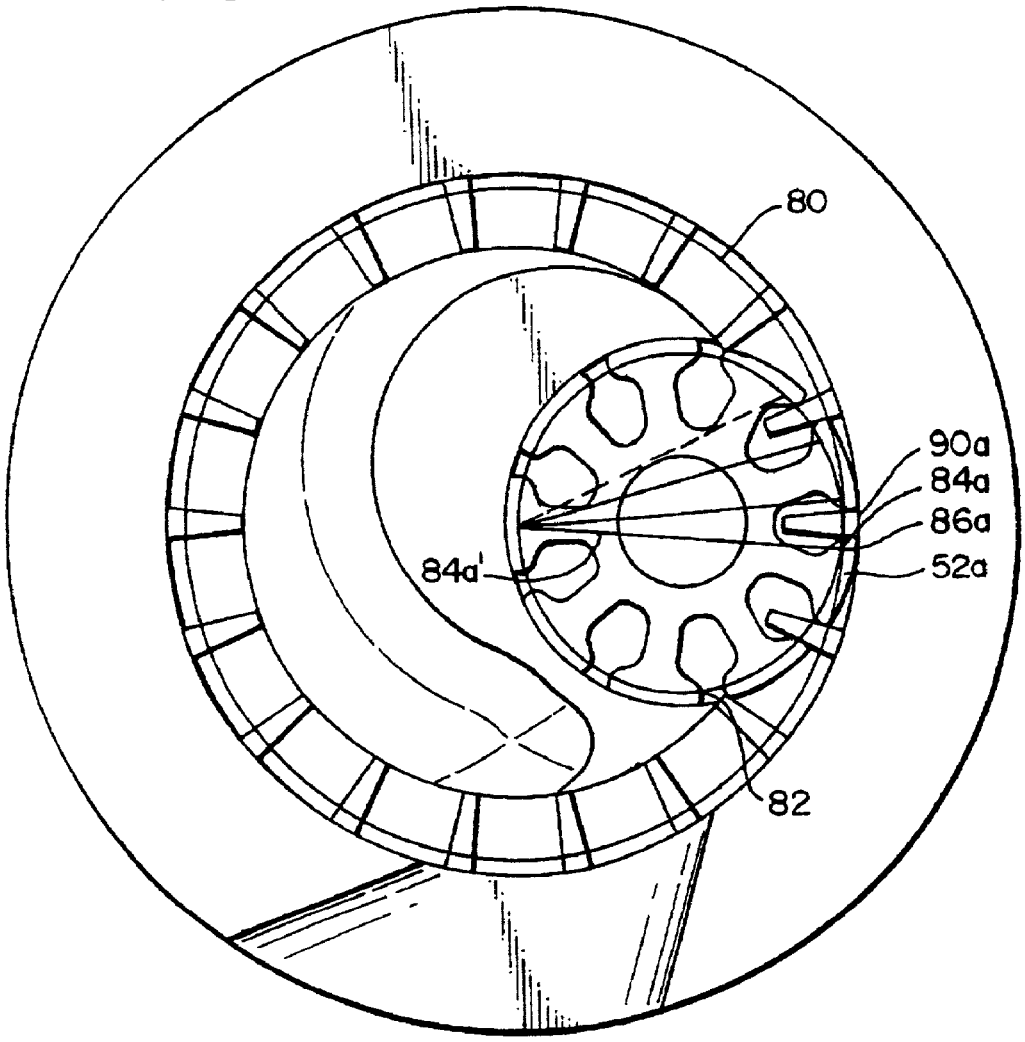
FIG. 10 shows the outer circle and inner circles superimposed upon the outer rotor and inner rotor respectively.

As seen in FIG. 1, there is shown a first embodiment of the apparatus 20 comprising a rotor assembly 21 and a housing 25. Shown in FIG. 1, the rotor assembly 21 comprises an outer rotor 22, and an inner rotor 24. The outer rotor 22 has an outside diameter d (FIG. 2) and a center point indicated at 26 that indicates the location of the axis of rotation for the outer rotor 22. The outer rotor further has a plurality of fins 28 discussed further herein. As shown in FIG. 10, the outside rotor further has an outer reference circle 80 and the inner rotor 24 has an inner reference circle 82 that is one half of the diameter of the outer reference circle 80. The significance of this geometrical integer ratio requirement is discussed further herein.

Now referring back to FIG. 2, the fins 28 each have a central axis 30 that extends through the center point 26. The fins 28 further comprise a forward surface 32 and a rearward surface 34. It should be noted that surfaces of 32 and 34 are substantially flat and aligned to the transverse axis. The outer rotor 22 further comprises the surface 40 that is located in the transverse plane and partially defined sealed chambers discussed further herein. As seen in FIG. 2, a semi chamber (or semi chamber region) 42*d* is defined as surface 40*d*, forward surface 32*d*, and rearward surface 34*c*. Located in the radially outward portion of the outer rotor 22 is a peripheral edge portion 44 that defines a circle about center point 26. The peripheral edge 44 is adapted to intimately engage the housing 25 to form a compression chamber discussed further herein.

The inner rotor 24 has a center of rotation indicated at 50 and a plurality of legs 52. Each leg has a foot portion 54 that has a heel portion 56 and a toe portion 58. The foot 54 further comprises a radially outward surface 60. The heel portion 56 has a contact surface 62 that is adapted to engage the rearward surface 34 of the fins 28. The toe portion 58 has an toe surface 64 that as adapted to engage the forward surface 32 of the fins 28.

Each leg 52 further has a rearward surface 65 and a forward surface 66. Opposing forward and rearward surfaces 65 and 66 facing one another (e.g. 66*d* and 65*c*) define an inner rotor chamber 67.

There will now be a discussion of the geometric relationship between the inner rotor 24 and the outer rotor 22. As previously mentioned above, FIG. 2 shows an embodiment where the rotor 24 has nine legs 52 with nine corresponding foot portions 54. The radially outward surface surfaces 60 of the foot portions 54 define at least in part a circular cylinder in the transverse axis about center point at 50. As shown in FIG. 2, there are twelve semi chamber regions 42 of the outer rotor 22. The number of semi chamber regions in the outer wheel in the embodiment shown in FIG. 2 is twice the number of legs 52 of inner rotor 24.

As previously mentioned above, in the first embodiment the circumference the outer reference circle 80 of the outer rotor 22 is exactly twice the circumference of the inner reference circle 82 of the inner rotor 24. Therefore, as the inner rotor wheel 24 rotates about center point 50, the inner rotor's rotations per minute is exactly twice the rotations per minute of the outer rotor 22. The ratio between the circumferences of the inner rotor 24 and the outer rotor 22 is a factor of two. As discussed further herein the ratios between the inner rotors and the outer rotor will be the ratio of the number of legs 52 and fins 28 of the inner and outer rotors as a direct relationship with ratio of the inner and outer radii of the inner and outer rotors 24 and 22. In other words the number of legs (Λ)divided by the number of chambers (X) defined by the fins is equal to the radius of the inner reference circle r.sub. 1 divided by the outer reference circle $r_o$ (i.e. $\Lambda./X=r_i/r_o$).

Of course there is a linear relationship between the radius, diameter, and circumference of a circle. Therefore, the ratios between the diameter of the inner rotor 24 and the diameter of the outer rotor 22 is the same as the ratio between the circumference of the inner rotor 24 and the circumference of the outer rotor 22.

Figure 9:
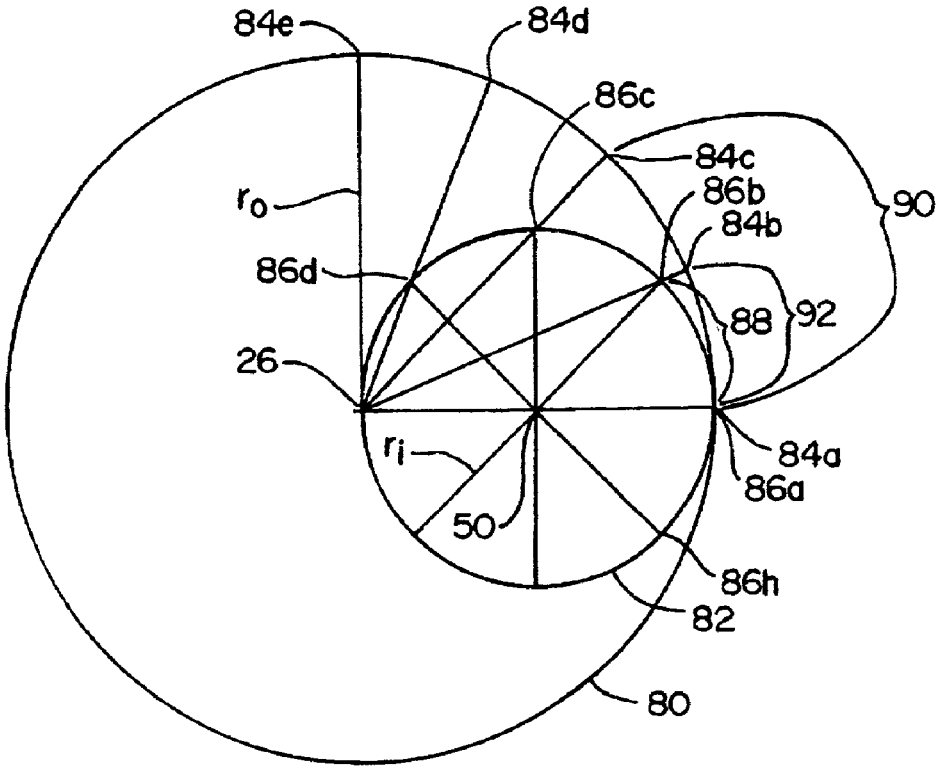
FIG. 9 is a schematic view illustrating the geometries for the outer circle and inner circle.
Figure 11:
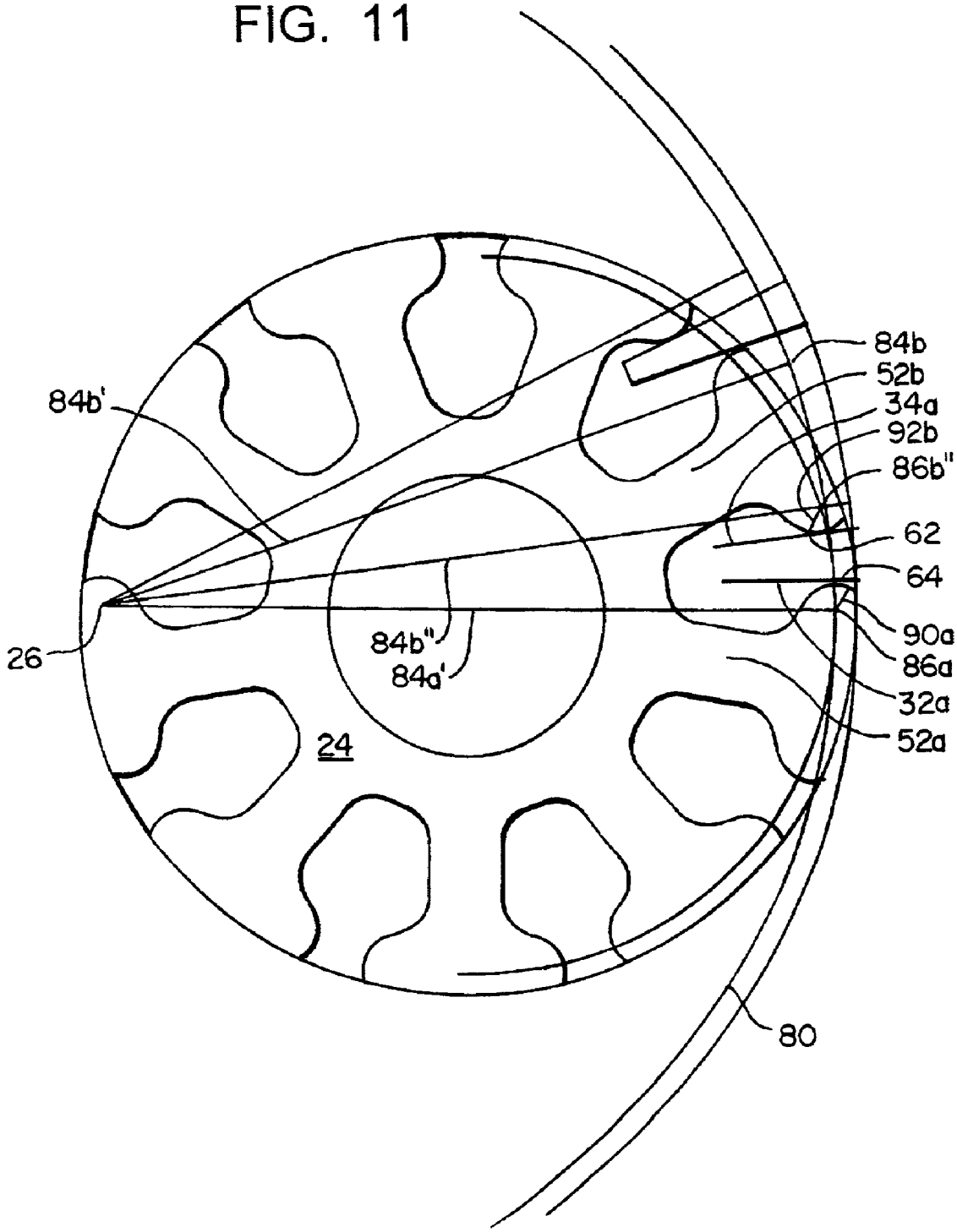
FIG. 11 shows the geometric relationship of the inner and outer rotor where the method of defining the contact surfaces for the legs of the inner rotor and the fans of the outer rotor a shown.

There will now be a discussion of the forward and rearward surfaces 32 and 34 of the outer rotor 22 with reference being made to FIGS. 9–11. FIG. 9 shows an outer reference circle 80 and an inner reference circle 82. The outer reference circle has sixteen pie sections spaced at twenty two and a half degrees defining outer reference points 84*a*–84*p*. The inner reference circle 82 has eight evenly spaced pie sections at forty-five degrees defining inner reference points 86*a*–86*h*.

The center point 26 shown in FIG. 9 is the center of outer reference circle 80, and center point 50 is the center of inner circle 82. The radius of the outer circle indicated by $r_o$ is exactly twice see inner radius $r_i$. The circumference of a circle is a linear relationship with respects to the radius. The well-known equation is $c=2\pi r$. Therefore, one-half of a radius yields exactly one-half the circumference. Further, forty-five degrees of circumference section 88 for the inner circle 82 yields exactly one-half of the circumferential distance of forty-five degrees circumference section 90 for the outer circle 80. Therefore, twenty two and a half degrees (½ of forty five degrees) circumferential section 92 for the outer circle 80 yields the exact same circumferential distance as a 45 degree circumferential length 88 for the inner circle 82. So as the outer circle 80 rotates about center point 26 and the inner circle 82 rotates about center point 50 and the perimeters of each circle at point 84*a* move at the same speed, the inner circle 82 will rotates at exactly twice the rotational velocity of the outer circle 80. This rotational scheme is defined as the dual rotation.

By having the inner radius $r_i$ one-half the length of the outer radius $r_o$ there is an interesting mathematical phenomena where points 86 define linear lines on the outer circle 80 during dual rotation. In other words, as the circles rotate in the dual rotation fashion point 86*d* defines straight line 84*d*. Likewise, all of the points about the circumference of the inner circle define straight lines radially extending from the center point 26 are the outer circle 80.

With the foregoing geometric relationships in mind, reference is now made to FIG. 10 where the inner and outer circles 80 and 82 are superimposed upon the rotor assembly of the first embodiment. The point 86*a* is located on the toe portion of leg 52*a* and point 84*a* is at the exact same location. This location is referred to as the contact point where the circumference is of the inner circle 82 and the outer circle 80 cross. The line 84*a*' extends to point 86*a* when point 86*a* is in the contact point position. The toe surface 64 is defined by a semi circle having a center point at 84*a* and a radius of 90*a* (see FIG. 11). The center of toe surface 64 is point 86*a*. Therefore all points along toe surface 64 are equidistant from the point 86*a* at a distance 90*a*. To reiterate the geometric relationship phenomenon, as the inner and outer rotors 24 and 22 rotate in the dual rotation scheme described above, the point 86*a* will travel along the line 84*a*'. Therefore, rearward surface 32*a* must be parallel to line 84*a*'. In other words, as point 86*a* travels radially inwardly along line 84*a*' during the dual rotation scheme, the surface 32*a* must be parallel to radially extending line 84*a*' to avoid interference between the surface 32*a* and the toe surface 64.

In a similar analysis to describe surface 34*a*, line 84*b*" extends radially from center point 26 through 86*b*" located on the heel portion of leg 52*b*. The heel surface 62 is a semi circle in the lateral plane defined by a radius 92*b* about point 86*b*". As the point 86*b*" travels radially inward along line

84*b*" towards the center of the outer circle 80, the heel surface 62 will maintain contact along forward surface 34*a* because this surface is perpendicular to line 84*b*". The same analysis can be conducted for all of the fins 28 with the respective legs 52 lined adjacent thereto.

It should be noted that the preferred surface for the first embodiment for heel and toe heel surfaces 62 and 64 is a semi circle about a point. The semi circle allows the fins to have non-curved surfaces that radially extend from the outer reference circle 80. Other circular shapes for the heel and toe surfaces 62 and 64 could be employed with a varying radius.

In addition to having the reference circles 80 and 82 radii (and circumferences) a ratio of two to one, it is just as important to have the number of fins 28 lineof the outer rotor twice in quantity as the number of legs 52 lineof the inner rotor (see FIGS. 9–11). This integer ratio is crucial for having continuous rotation of the inner and outer rotors free from having a leg crashed down upon a fin for the first embodiment.

There will now be a discussion of the rotor assembly mounted in the housing 25 along with the various components of the apparatus 20 followed by a description of the compression scheme.

FIG. 1 shows the rotor assembly with the housing 25 in conjunction with the inner rotor 24 and the outer rotor 26. As seen in FIG. 3, the housing 25 is preferably a unitary designed having a central area 94, an exit/entrance portion 96, a discharge region 98, an entrance region 100, an outer rotor annular slot 102, an inner rotor annular slot 104, a high compression region 106, an expansion region 108 and finally an annular support region 110. The outer rotor annular slot 102 is adapted to house the outer rotor 22 (see FIG. 2). The outer rotor 22 can rotate therein slot 102 and press upon the inward annular surface 112 and the outward annular surface 114. Further, the annular slot has a surface 116 adapted to support the lower surface of the outer rotor 22. The inner rotor annular slot 104 is defined by radially inward facing surface 118 and a radially outward facing surface 120. The radially outward facing surface 120 is adapted to position the inner rotor 24. Further, the radially inward surface 118 is in close engagement with the radially outward surface 60 of the inner rotor 24. Therefore, surfaces 118 and 120 independently cooperate to hold inner rotor 24 and place to rotate about center point 50.

The outer rotor annular slot 102 and inner rotor annular slot 104 cooperate to assist in positioning the outer rotor 22 and inner rotor 24 so both rotors rotate about centerpoints 26 and 50 respectively.

The airflow into and out of the rotor assembly 20 is accomplished by the exit/entrance portion 96, the discharge region 98, and finally the entrance region 100. The exit/entrance portion 96 comprises an exit passage 122 and an entrance passage 124. The exit passage 122 comprises a first surface 126, a second surface 128 and upper and lower surfaces 130 and 132. A boundary corner is defined at numeral 134 and a second corner portion is indicated at 136. The entrance passage 124 comprises a first surface 138, a second surface 140, an upper and lower surfaces 144. A corner portion 146 is located at the juncture between surface 112*b* and first surface 138.

In another form, the exit and passage 122 is adjustable regarding its location with respects to a compression chamber and a manner so a desirable compression ratio between the compression chamber and the pressure at the exit chamber is maximized. The adjustment could include having the casing rotate with respects to the location of the inner rotor and hence adjust the boundary locations 134 and 136 of the exit passage.

Figure 4:
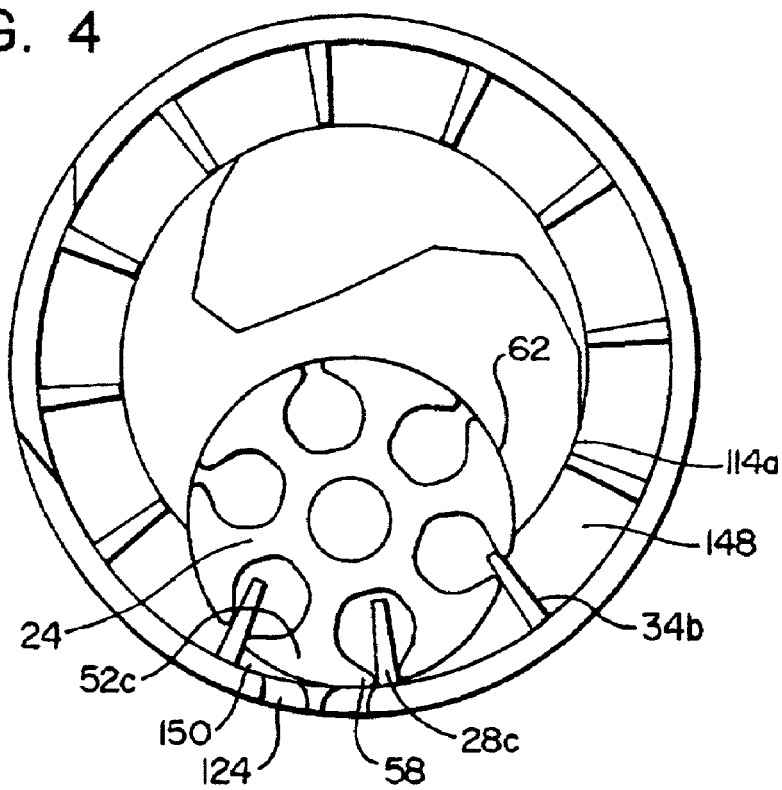
FIG. 4 is a first view illustrating a progressive cycle of compression of a compression chamber.

To properly understand the air flow scheme of the apparatus 20 there will first be a discussion of the chamber volume displacement. In general, a compression chamber 148 is defined by the radially outward surface 60*a*, the forward surface 32*a*, the rearward surface 34*b* the radially inward surface 112*a* and finally the upper and lower surfaces of the outer rotor 22. As shown in FIG. 4, as soon as the heel surface 62 of the heel portion 56 engages the radially inward portion of rearward surface 34*b* the sealed pressure chamber 148 begins to change in volume. The chamber 148 is sealed between the inner rotor 24, the outer rotor 26, and the housing 25. The radially inward portion of fin 28*a* is in tight communication with radially outward surface 114*a*. Likewise, the radially outward surface of fin 28*a* is in close communication with radially inward surface 112*a*. As the rotors 24 and 22 continue to rotate to a position shown in FIG. 5. when the toe surface 64 of the toe portion 58 engages the radially inward portion of forward surface 32*a* the pressure chamber 148 is now substantially sealed without the assistance of radially outward surface 114*a*.

Figure 6:
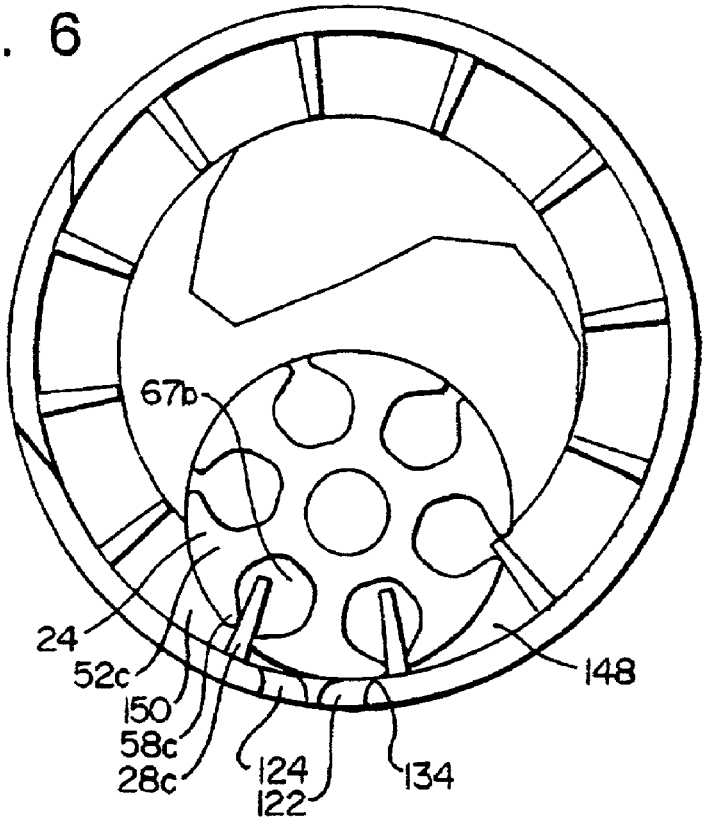
FIG. 6 is a third view illustrating a third stage and a compression cycle of a compression chamber where a portion of the compression chamber is exposed to and exit passage.
Figure 7:
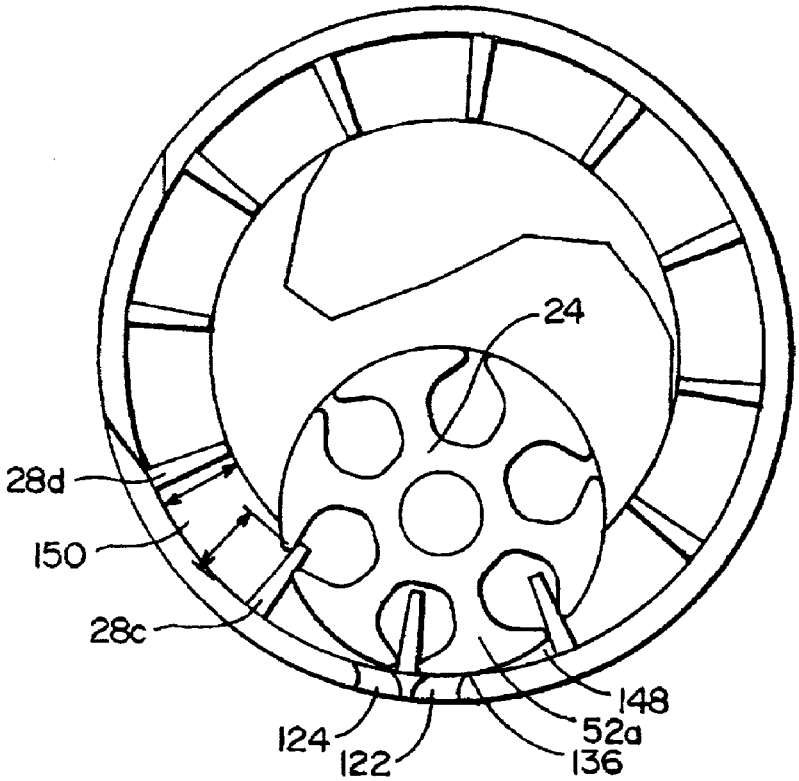
FIG. 7 is a fourth view illustrating the progression of a compression cycle.
Figure 8:
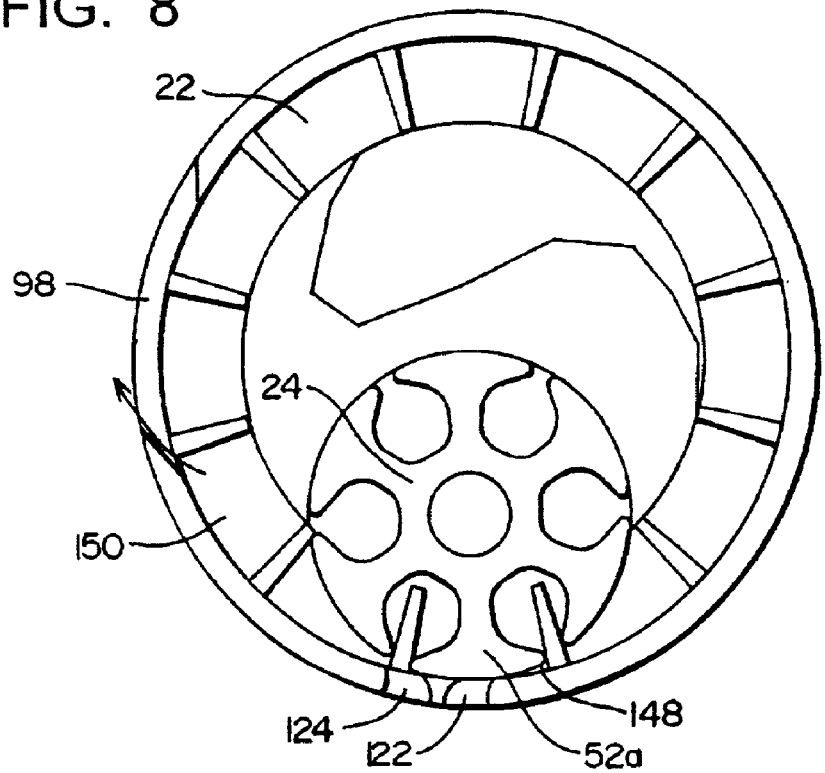
FIG. 8 is at this view illustrating the final phase of a single compression cycle for a compression chamber.

Now referring to FIG. 6, the inner rotor 24 has rotated a few additional degrees clockwise to a position where the radially outward portion of rearward surface 34*b* of fin 32*b* passes the boundary corner 134. At this point the pressure chamber 148 is in communication with the exit passage 122. As shown in FIG. 7, the air within pressure chamber 148 still being displaced by radially outward surface 60*a* as the inner rotor 24 continues to rotate. Finally, as shown in FIG. 8, the heel portion 56*a* of the leg 52*a* is past the corner portion 136 and radially outward surface 60*a* is in engagement with surface 112*b*. The contact between surfaces 60*a* and 112*b* maintains a seal between the exit passage 122 and the entrance passage 124. At this position, the pressure chamber 148 is almost completely displaces the air therefrom into the exit passage 122. Of course the compression ratio of the gas inside the chamber 148 can be adjusted by positioning the boundary corner 134 to various radial locations and the casing could provide an adjustable device for accomplishing this. As seen in FIG. 2, the radially outward portions of the fins 28 have a slight tangential taper. This taper receives the corner portions of the toe and heel portions 58 and 56 of the legs 52. Therefore, the tangential taper prevents air from being trapped into the corners between the forward and rearward surfaces 32 and 34 and the housing 25. This is desirable because maximum gas displacement can occur if the compression chamber 148 is completely displaced.

The gas entrance phase will now be discussed with reference again made to FIGS. 4–8. This description is relevant to using the device as a motor where expanding gas is used for output work. The output work could, for example, be extracted as torque from a shaft attached to the inner or outer rotors or alternatively used from compressed gas in a manner as described above for a "cold blow" work output.

As seen in FIG. 4, gas enters in entrance passage 124 and enters into expansion chamber 150. The expansion chamber 150 is defined as the particular inner rotor chamber 67 that is in communication with entrance passage 124.

As seen in FIG. 6, the inner rotor chamber 67*b* is not directly in communication with exit passage 122; however, the seal between fin 28*c* and toe portion 58*c* of leg 52*c* is not a perfect seal and some higher pressure gas can seep into chamber 67*b*.

Figure 5:
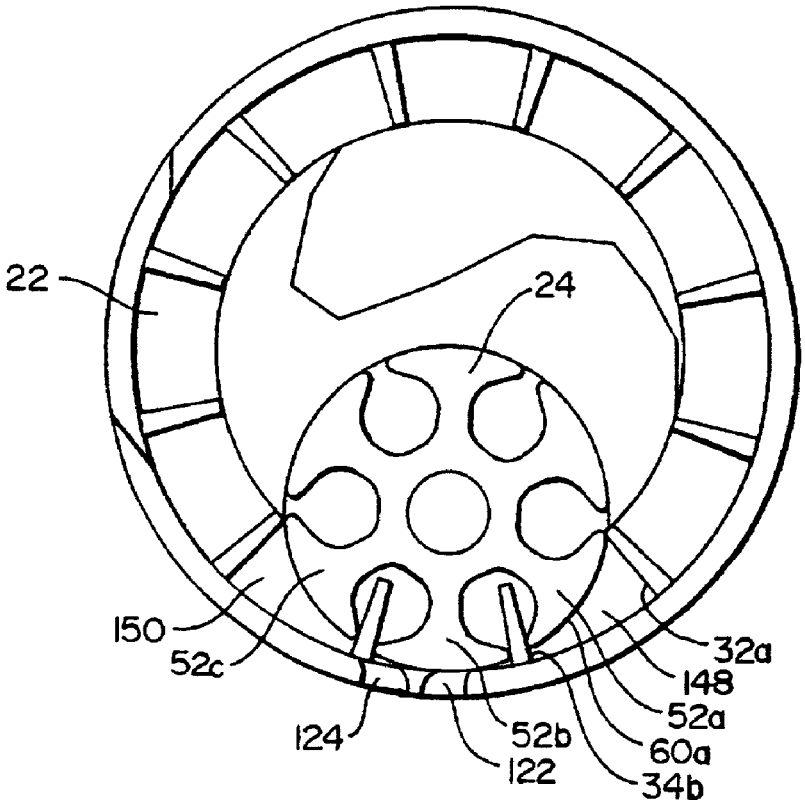
FIG. 5 is a second view illustrating a second position of a cycle of compression of a compression chamber where the base of a foot begins displacing the gas contained therein.

As the inner and outer rotors 22 and 24 are positioned in the matter shown in FIG. 5, inner rotor chamber 67*b* is now substantially sealed from exit passage 122 and entrance passage 124. However, the pressure in chamber 67*b* may be slightly greater than the pressure in entrance passage 124.

As seen in FIG. 5, the leg 52*c* is near the radially inward portion of entrance passage 124. Shown in FIG. 6, the inner rotor 24 has rotated additional degrees clockwise and the expansion chamber 150 is increasing in volume. It is important to note that it is undesirable to have the expansion chamber 150 sealed and not be in communication with the entrance passage 124. If the device is solely used as a compressor where work input does not come from expanding gas in chamber 150. If the expansion chamber was substantially sealed between surfaces 112*c*, 34*d*, 32*c* and 60*c* as the chamber 150 increases in volume corresponding to the clockwise rotation of rotors 22 and 24, the low-pressure therein would create a counter clockwise force as a result of the tangential surface difference between rearward surface 34*d* and forward surface 32*c* (this is discussed further herein below in the engine embodiment).

As seen in FIG. 7, the expansion chamber 150 has increased in volume with respect to the location in FIG. 6. The distance $dr_1$ indicates the amount of surface area exposed in the radial direction (presuming a finite amount of depth). The distance $dr_2$ represents the amount of surface area in the radial direction for the fin 28*d*. It is therefore apparent that a positive clockwise torque is created upon the outer rotor due to the increase in surface area of distance $dr_2$ over $dr_1$.

In FIG. 8 the expansion chamber is fully expanded and now defined by the surfaces 112*c*, 114*b* and forward surface 32*c* and rearward surface 34*d*. Finally, the air is subjected a centrifugal force and ejected through the discharge region 98.

Figure 12:
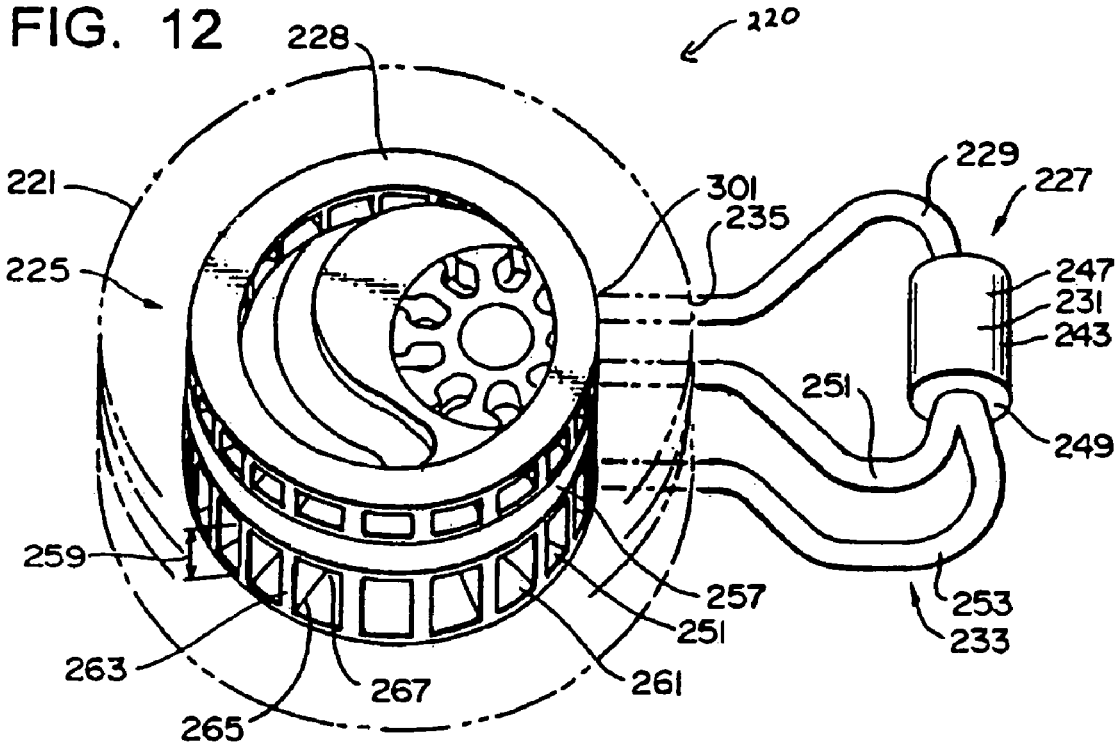
FIG. 12 shows an external combustion engine embodiment.

There will now be a discussion of how air enters into the semi chamber regions 42 of the outer rotor 22. In the external combustion engine embodiment discussed further herein below, it is desirable to have gas that contains oxygen (e.g. air) without other contaminants such as the exhaust from the combustion chamber 231 (FIG. 12). Therefore, as seen in FIG. 1, as the outer rotor 22 rotates in the direction indicated by arrow 151. The air is drawn in through the entrance region 100. The entrance region 100 comprises glide surface 152 having generally downward slope in the radial outward and tangentially clockwise direction. As discussed above, the rotations per minute of the outer rotor 22 are in the order of magnitude in the thousands to hundreds of thousands with certain materials in certain configurations. At this high-speed air channeled through the entrance region 100 is "pre-compressed" into the semi chambers 42. The compression at this phase is similar to a centrifugal compressor. When the rearward fin 28 of semi chamber 42 passes the position 154 (FIG. 3) the semi chamber is now substantially sealed and ready for the gas contained therein to pass to the high compression region 106.

There will now be a description of a second embodiment with reference to FIG. 12. This embodiment is similar to the first except the rearward portion of the apparatus 220 contains a second rotor assembly 223. The defined components of the first embodiment carryover to the first rotor assembly 221 of the second embodiment and the numerals designating these components correspond thereto except our increased by two hundred(e.g. the correspondent fins 28 of the first embodiment are represented as numeral 228 in the second embodiment).

In general, the second embodiment discloses an external combustion engine where a second rotor assembly 223 is employed to receive exhaust gas from a combustion chamber 227. The second outer rotor 245 is connected to the outer rotor 228 so both rotate in conjunction with one another. The exhaust exiting the combustion chamber 227 is of greater volume than the exhaust entering through passage 229 and is greater volume is channeled into the expansion chambers 250 and 251 of the first and second rotor assemblies 221 and 223. A portion of the output work of the second rotor assembly 223 is used to compress the air exiting the exit passage 253 of the first rotor assembly that is directed into the combustion chamber 229. The remainder of the work output of the second rotor assembly 223 can be displaced into an output shaft attached to the outer rotor 255. Alternatively, compressed air exiting the exit passage of the second rotor assembly 223 can be utilized for a "cold blow" discussed further herein. Further, a portion of the exiting air from the combustion chamber could be channeled off for a "hot blow" also discussed herein. The casing portion that would encase the outer fins in FIGS. 12, 14 and 15 is not shown in order show the interior fins.

The second embodiment apparatus 220 comprises a first rotor assembly 221, a second rotor assembly 223, a housing 225, and an external combustion system 227. The external combustion system 227 comprises a passage 229, a combustion chamber 231 and an exit passage assembly 233. The passage 229 has a first portion 235 in communication with the exit passage 301 of the first rotor assembly 221. The passage 229 further has a second portion 237 in communication with the entrance region 249 of the combustion tank 231.

Figure 14:
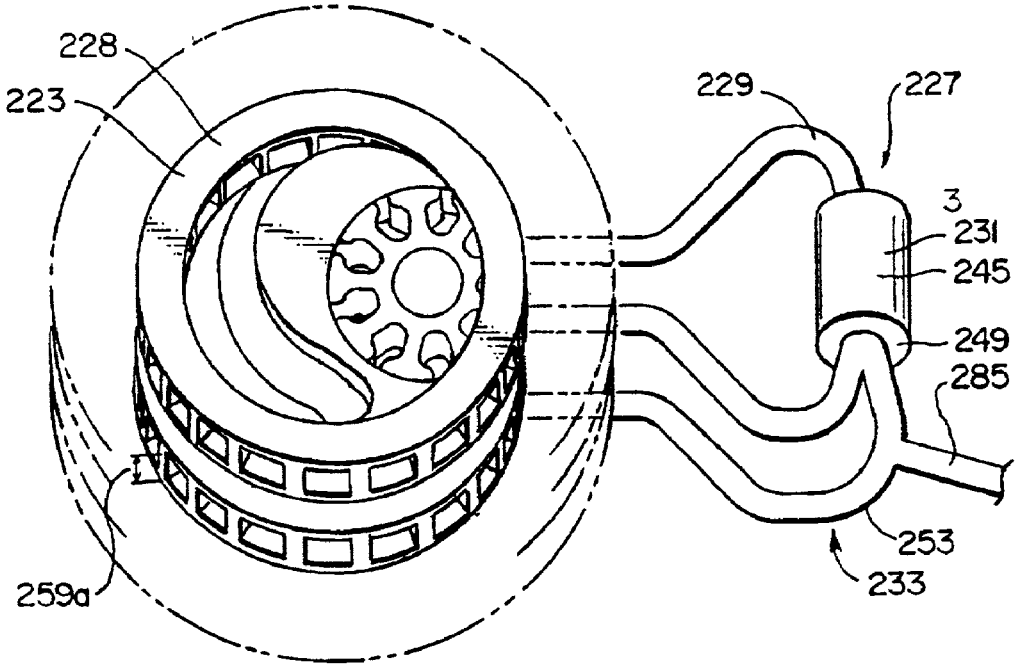
FIG. 14 shows a second embodiment of an external combustion engine where he portion of the exiting gas is used for a "hot blow"
Figure 15:
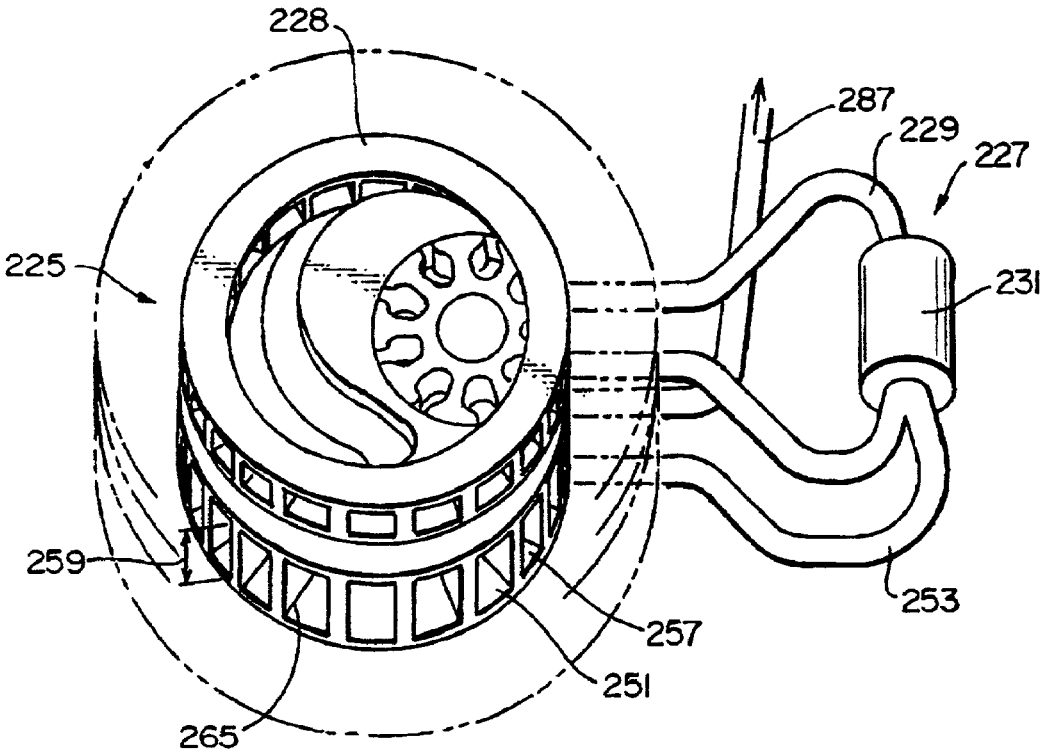
FIG. 15 shows a third embodiment of an external combustion engine or a second rotor assembly is employed to create a "cold blow"

The combustion chamber 231 schematically shown in FIGS. 12, 14 and 15 comprises a combustion tank 241, a fuel inlet system 243 and an ignition system 245. The combustion tank 241 has an entrance region 247 and an exit region 249.

The exit passage assembly 233 comprises a first passage 251 and a second passage 253. The first passage 251 places the exit region 249 of the combustion tank 241 in communication with the expansion chamber region 330 of the first rotor assembly 221. The second passage 253 places the exit region 249 of the combustion chamber 241 in communication with the expansion chamber region of the second rotor assembly 233.

The external combustion system 227 can be of a conventional design. The important aspect of the external combustion system 227 is the volume of gas increases at the exit region 249 with respects to the entrance region 247 of the combustion tank 231. Therefore the combustion system 227 could be a heat exchanger or other device to increase the temperature of the gas passing therethrough.

The second rotor assembly 223 comprises an outer rotor 255 and an inner rotor 257. The depth of the rotor assembly in the transverse direction is indicated by distance 259. The significance of the depth of the second rotor assembly and a corresponding effect of increasing the exit chamber region 261 volume is discussed further below. The second rotor assembly further comprises an exit chamber region 261 that is adapted to receive exhausting gas from the second passage 253. The outer rotor 255 comprises a plurality of fins similar to that of FIG. 1. The surface 265 is defined between the surface area in the lateral plane between two adjacent fins 263. The volume between two adjacent fins is defined as a semi chamber 267 which is a function of the area of surface 265 multiplied by the height 259.

There will now be a discussion of the operations of the second embodiment with emphasis drawn towards the amount of change of volumetric flow of gas in the external combustion system 227 corresponding to the volumetric ratio of the semi chamber 240 with respects to the total volume of semi chamber 240 and the semi chamber 267.

As the compressed gas (presumably air) is ejected from the exit region 322 of the first rotor assembly 221, the compressed air flows through the passage 229 into the combustion chamber 231. The oxygen in the combustion chamber is ignited with fuel from the fuel inlet system 243. This reaction causes and expansion of the gas at a near constant pressure. The combusted gas then exits through the exit passage assembly 233. It should be noted that the external combustion system is an open system therefore there must be a slight pressure decrease to induce a flow of gas therethrough. However, the increase of volume of exiting gas is utilized to create work.

Figure 13:
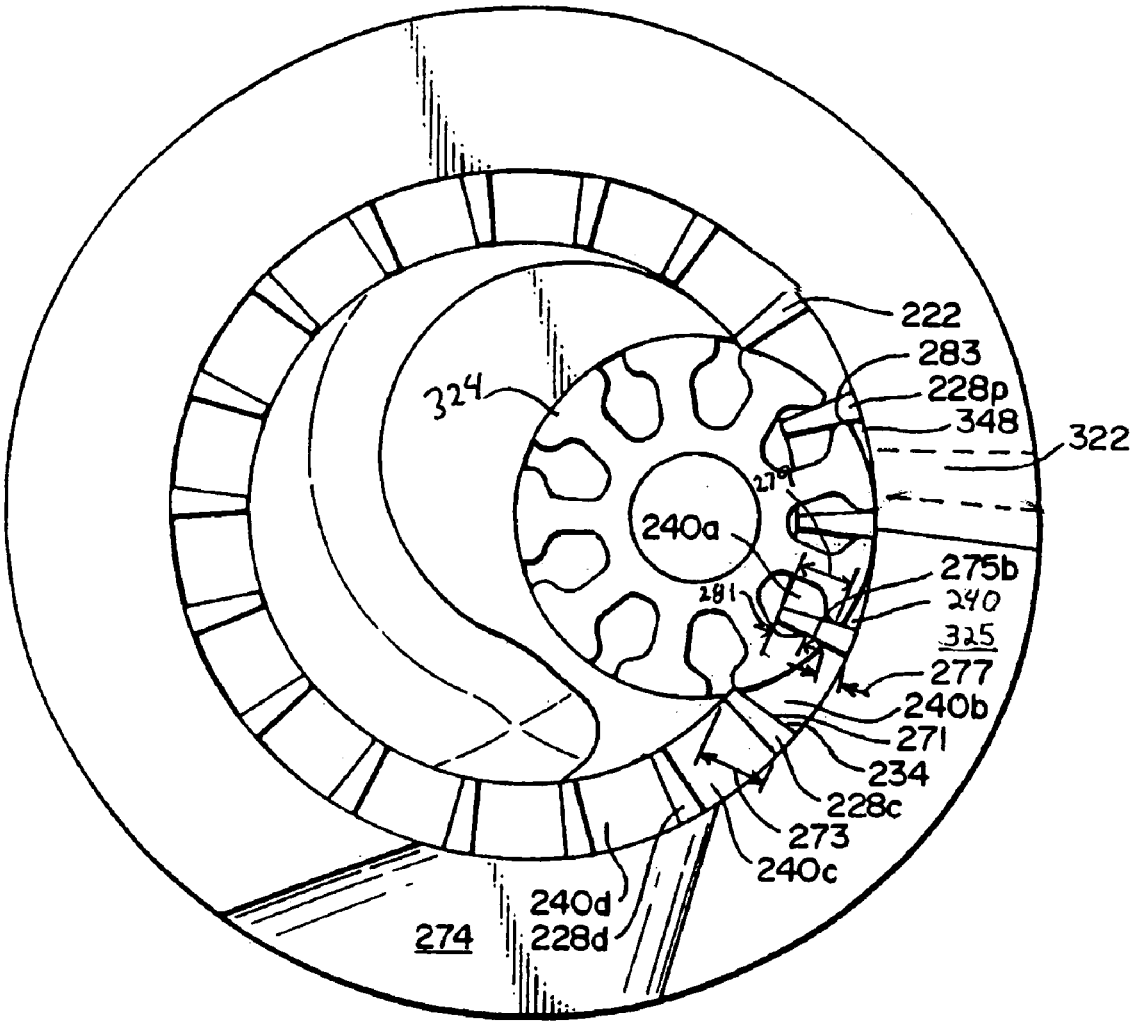
FIG. 13 illustrates the analysis of expansion and compression to create an overall torque for the rotor assembly.

The increase in volume of gas is accommodated by providing expansion chambers in the first and second rotor assemblies 221 and 223. As seen in FIG. 13, there is shown a cross-sectional view of the second rotor assembly 223. The forward tangential surface area 271*c* of the fin 228*c* is indicated by distance 273 (where the distance in the longitudinal direction is the same for all surfaces discussed below hence the distance in the radial direction is proportional to the corresponding surface areas). The rearward tangential surface area 275*b* is indicated by distance 277. Therefore, the tangential force upon the outer rotor 222 from the pressure in the semi chamber 240*b* will be in the clockwise direction. The magnitude of this substantially tangential force is a function of distance 273 minus distance 277 multiplied by the depth of the fins 222 multiplied by the pressure within the exit chamber region 325. The radially differential distance is defined as distance 273 minus distance 277. A likewise analysis could be connected on semi chamber 240*a* where distance 279 is greater than distance 281 to provide a tangential force/pressure differential in the clockwise direction. This analysis is illustrative of the pressure scheme to provide a torque on the external rotor 222.

As the outer rotor 222 rotates in the clockwise direction the gas housed in the semi chambers 240 is expelled out the discharge region 274. Therefore as seen in FIG. 13 the pressure in semi chamber 240*d* is atmospheric or very close thereto. The pressure difference upon the fin 228*d* causes a substantial pressure force causing a clockwise rotation of the outer rotor 222.

The compression chamber 348 has a counter clockwise torque applied upon fin 228*p*. The counter clockwise torque is a function of the surface area indicated by distance 283. Even though the pressure in entrance passage 325 is less than the pressure in the compression chamber 348, the net surface area in the tangential direction for the outer rotor 222 is greater and hence the differential tangential surface area is greater in the clockwise direction and hence the gas exiting the combustion chamber 271 can self-propel the rotor assembly 221.

As an alternative to directing all of the gas to passageway 235, a portion of the compressed air can be past the combustor 231 to run the compressor and the remainder of the gas can be directed to a conduit for "cold blow" work. Further, the first and second rotor assemblies 221 and 223 do not have to be connected where the outer rotors rotate independent of one another.

FIG. 14 shows a variation of the second embodiment where the exit assembly 233 further comprises a hot blow conduit 285 where a portion of the exhausting gas from the combustion chamber 231 is expelled and used for work. An additional modification of the apparatus shown in FIG. 12 is the depth of the second rotor assembly 223 is reduced. Therefore distance 259*a* is less than distance 259 of FIG. 10. This results in a lower volume of the semi chambers 267. The semi chambers 267 require less volume because a portion of the output post combusted gas is directed to hot blow conduit 285. Hence, the main function of the second rotor assembly is to supply a clockwise torque to assist in compressing the air in the compression chambers 348 (see FIG. 13) of the first rotor assembly to supply compressed air to the external combustion system 227. Alternatively, the second rotor assembly 223 could be removed entirely and only the first rotor assembly 221 would provide less compressed air to the external combustion system 227. Then all of the exiting gas from the external combustion system 227 could be used for a "hot blow"for work output.

FIG. 15 shows another variation of the second embodiment where the exit passage of the second rotor assembly 223 is in communication with a cold blow conduit 287. In this version the work output from the apparatus 220 is transformed to a compressed gas that was not directly disbursed from the external combustion system 227. The cold blow conduit 287 is in communication with an exit passage of the second rotor assembly 223 that is very similar to the exit passage one along shown in FIGS. 3–8. Therefore, gas entering and through the entrance region of the second rotor assembly (again similar to entrance region 100 shown in FIGS. 3–8). Is compressed in the compression region and disbursed through the exit passage (see numerals 106 and 122 respectively in FIG. 3). The embodiment shown in FIG. 15 is particularly advantageous when compressed air is desired without the contaminants from the gas expelled from external combustion system 227 or with the heat generated by the same.

It should be noted that the second rotor assembly does not necessarily need to be housed in together with the first rotor assembly to have a functioning apparatus 220.

We have thus far discussed two embodiments of the present invention, both of which employ a single outer rotor 22 and a single inner rotor 24. There will now be a discussion of a third embodiment employing two inner rotors while still maintaining a two to one ratio between the outer reference circle 380 of the outer rotor 322 and the inner rotors 324. In a similar numbering fashion as the second embodiment, the numerals designating the components of the third embodiment will correspond, where possible, to the numerals describing similar components except the numeric values will be increased by three hundred.

Figure 16:
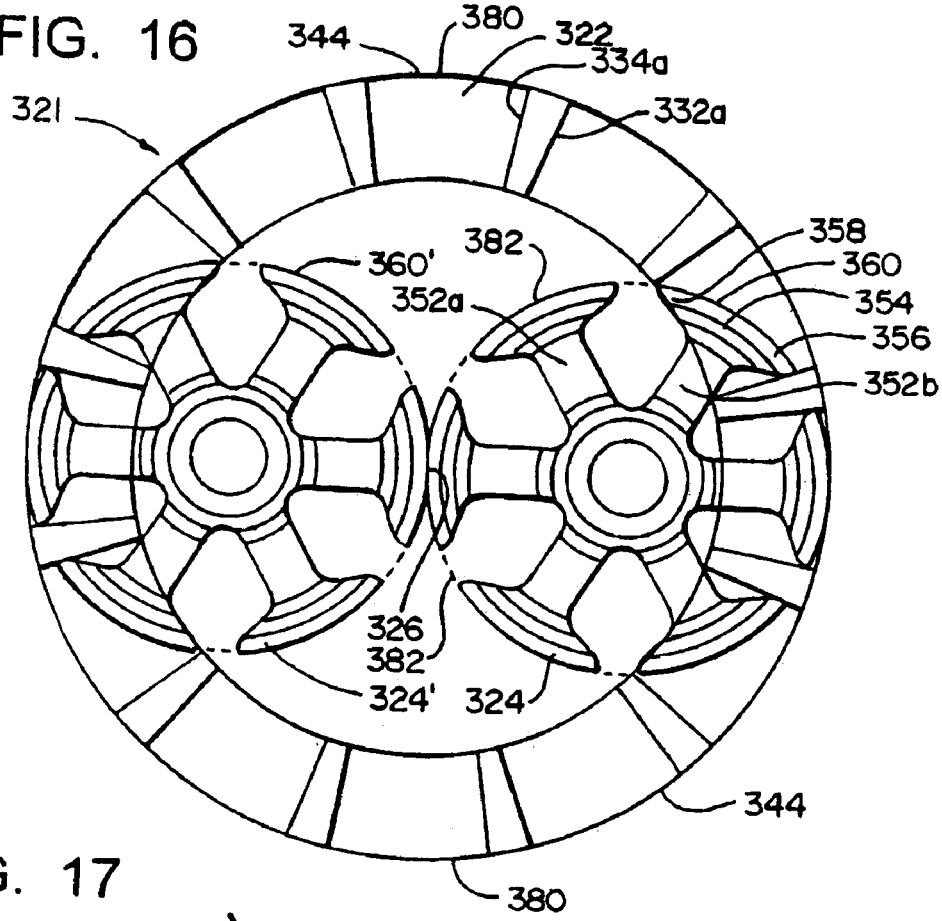
FIG. 16 shows a day modification to the first embodiment where to interior rotors are employed wall maintain an aspect ratio of two to one with respect to the outer and inner reference circles.

As shown in FIG. 16, the rotor assembly 321 comprises an outer rotor 321, a first inner rotor 324 and a second inner rotor 324'.

The outer rotor 321 is very similar to the outer rotors 22 and 222 in the first and second embodiments except for different angles of the forward and rearward surfaces 332 and 334. The center point 326 is the center of rotation for the outer rotor 322. The reference circle 380 for the outer rotor coincides with the peripheral edge 344 also having a center point 326.

The inner rotors 324 and 324' are substantially similar and hence inner rotor 324 will be described in detail with the understanding the description also relates to inner rotor 324'.

The inner rotor 324 comprises a plurality of legs 352 where each leg has a foot portion 354. The foot portion 354 comprises a heel portion 356, a toe portion 358, and a radial outward surface 360. The radial outward surface 360 defines a circle about point 350. The inner reference circle for the inner rotor 324 is indicated at 382 and coincides with the circle defined by radially outward surface 360.

Figure 17:
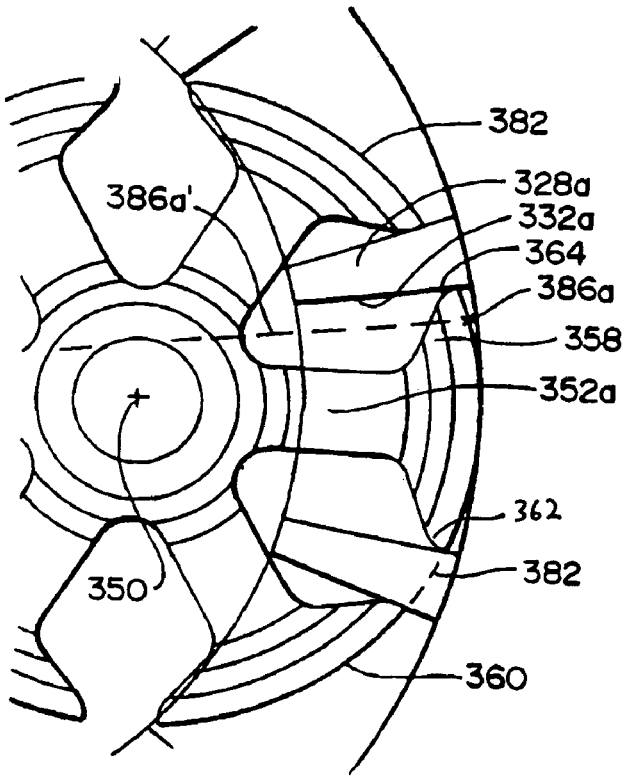
FIG. 17 is an exploded view showing the method of calculating the contact surface for the leg of the inner rotor.

As seen in FIG. 17, the forward surface 364 of the toe portion 358 is semi circular about point 386*a*. The point 386*a* lifelong the inner reference circle 382 (as well as the circle defined by radially outward surfaces 360). The significance of having the reference point at this radially outward extreme location from the center point 350 is discussed further herein.

There is now a description of the forward and rearward surfaces 332 and 334 of the fins 328. The analysis of the forward and rearward surface 332 and 334 is very similar to the analysis of surfaces 32 and 34 of the first embodiment discussed above referring to FIGS. 9–10. The main difference in the third embodiment is the point 386 is located on the radially outward surface 360, whereas in the first embodiment the point 86 is located a distance radially inward from the radial outward surface 60.

The line 386*a*' extends from the reference point 386*a* to the center point 326 of the outer reference circle 380 (see FIGS. 16 and 17). When the inner and outer rotors 324 and 322 engage in the dual rotation scheme, the reference point 386*a* travels radially inward along line 386*a*'. Therefore, forward surface 332*a* must be parallel to the line 386*a*'. A similar analysis can be conducted for the rest of the surfaces 364 and 362 of the inner rotors 324 and 324'.

By having the outer reference circle 382 coexisting with the radially outward surface 360 or slightly radially outward from radially outward surface 360, the rotor assembly 321 can fit the second rotor 324' into the housing as well.

In a preferred form, the inner reference circles 382 and 382*a*' are a small tolerance distance from the radially outward surfaces 360 and 360' to avoid interference between these surfaces at the center point location 326.

It should be noted that the third embodiment could be used for an external combustion engine in a similar manner as shown in the second embodiment.

Figure 18:
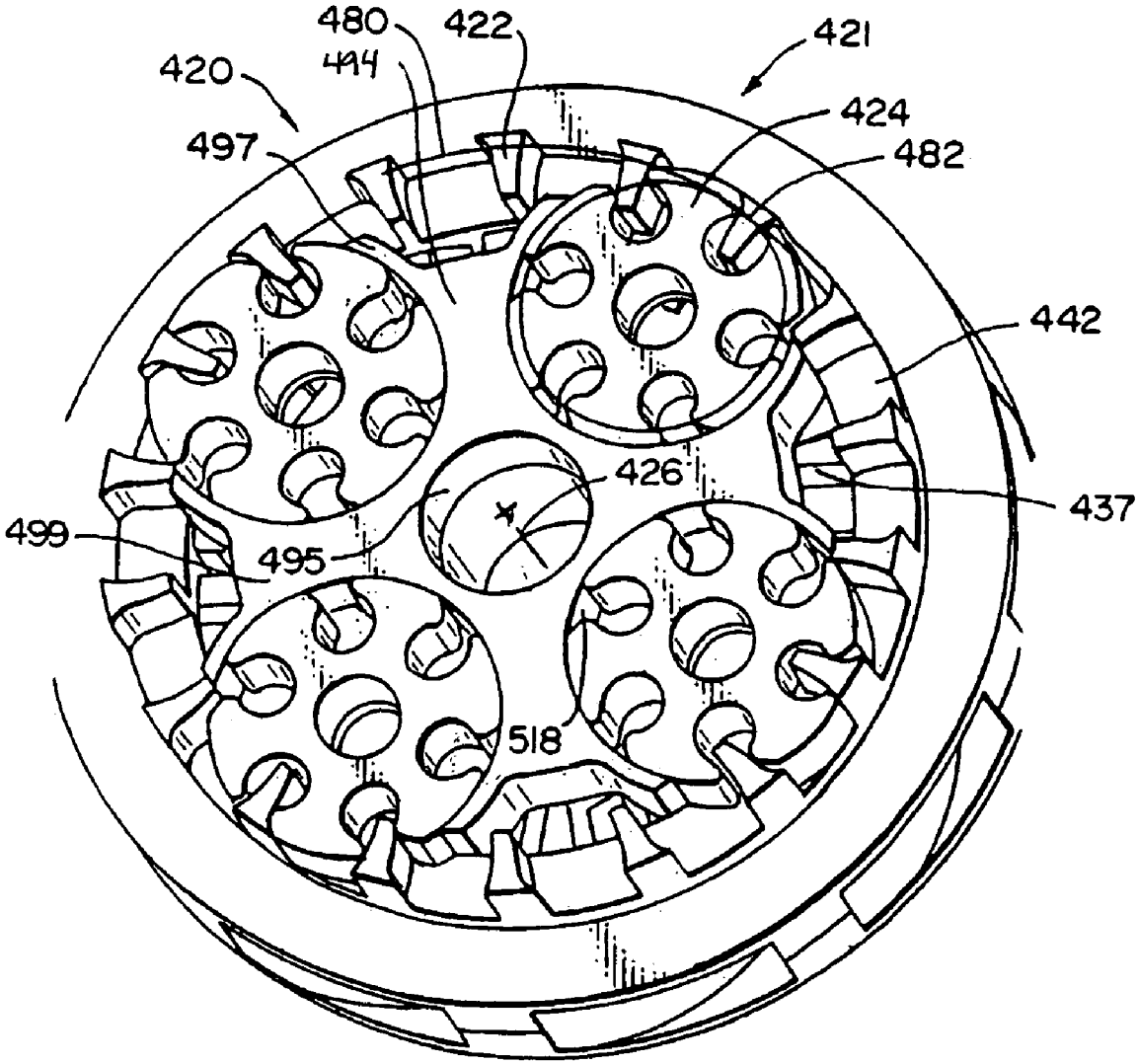
FIG. 18 shows an isometric view of the preferred embodiment where a plurality of interior rotors are employed.

The fourth embodiment is shown in FIG. 18 where four inner rotors are employed. The fourth embodiment has advantages of allowing a throughput shaft that is attached to the outer rotor 422. As with the previous embodiments, the numerals for the most part correspond with the first embodiment except increased by four hundred.

The apparatus 420 has a rotor assembly 421 that comprises an outer rotor 422 and a plurality of inner rotors 424*a*–424*d*. The outer rotor has a reference circle 480 and a center of rotation indicated about axis 426. Likewise, the inner rotors 424 have been inner reference circle 482. In a similar manner with the previous embodiments the relationship between the circumference of the inner reference circle and the outer reference circle 482 and 480 is a ratio that is an integer and in this embodiment a ratio of 3-1.

The relationship between the ratio of the number of legs 52 and fins 28 of the inner and outer rotors has a direct relationship with ratio of the inner and outer radii of the inner and outer rotors 24 and 22. In other words the number of legs (Λ) divided by the number of chambers (X) defined by the fins is equal to the radius of the inner reference circle $r_i$ divided by the outer reference circle $r_o$ (i.e. $\Lambda/X=r_i/r_o$).

Further, the outer rotor has 18 fins and the inner rotors have six legs (a ratio of 3-1). It should be noted that although the fourth embodiment discloses four interior rotors 424, there can be one—four interior rotors. However, having four interior rotors as particular benefits of balancing the force upon the central shaft described further herein.

Figure 19:
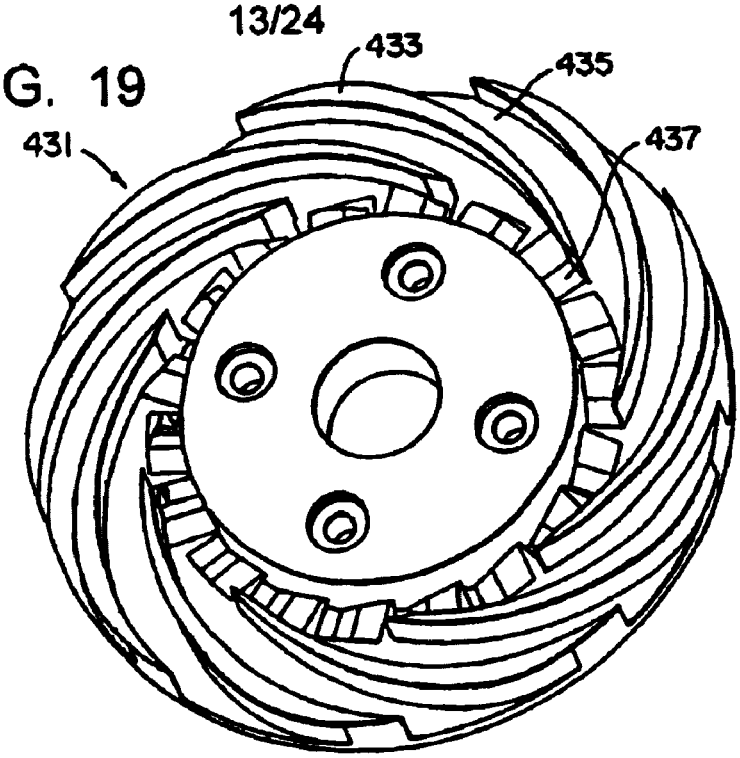
FIG. 19 is an isometric view showing a backside of the preferred embodiment shown in FIG. 18 or a scoop section is shown.

The rotor 422 further comprises a scoop region 431 best shown in FIG. 19 which shows the backside of one of the rotor assembly support 420 of FIG. 18. As seen in FIG. 19, the scoop region 431 comprises a plurality of vanes 433 define channels 435 that channel the air radially inward to the longitudinal extensions 437. Now referring to FIG. 18, the extensions 437 channel air into the chambers 442. The scoop region 431 is connected to and can be a unitary structure with the outer rotor 422. FIG. 18 shows an embodiment where two apparatuses 420 are positioned in a back-to-back arrangement having two outer rotors 422 and eight inner rotors 424.

The apparatus 420 further comprises a central frame member 494 that has a central open region 495 and annular interior surfaces 518 that are adapted to house the inner rotors 424. Further, a radially recessed region 497 allows communication to the longitudinal extensions 437 of the scoop region 431.

Finally, the apparatus 420 has a housing (not shown) that is connected to the front face 499 of the central frame member 494. The housing provides a seal in a similar manner to the housing is shown in FIG. 1, except a plurality of interest and exit ports would be provided for each interior rotor 424. Further, the previous examples of employing a combustor is possible with this embodiment where the input and output ports would be properly directed to and from the combustor to comprise the various embodiments creating hot blows, cold blows, or torques on driveshafts through an apparatus.

As with the previous embodiments, the apparatus can be used as any device to covert energy such as a steam engine, air motor, flow meter, compressor, pump, gas expander, combustion engine, etc.

Figure 20:
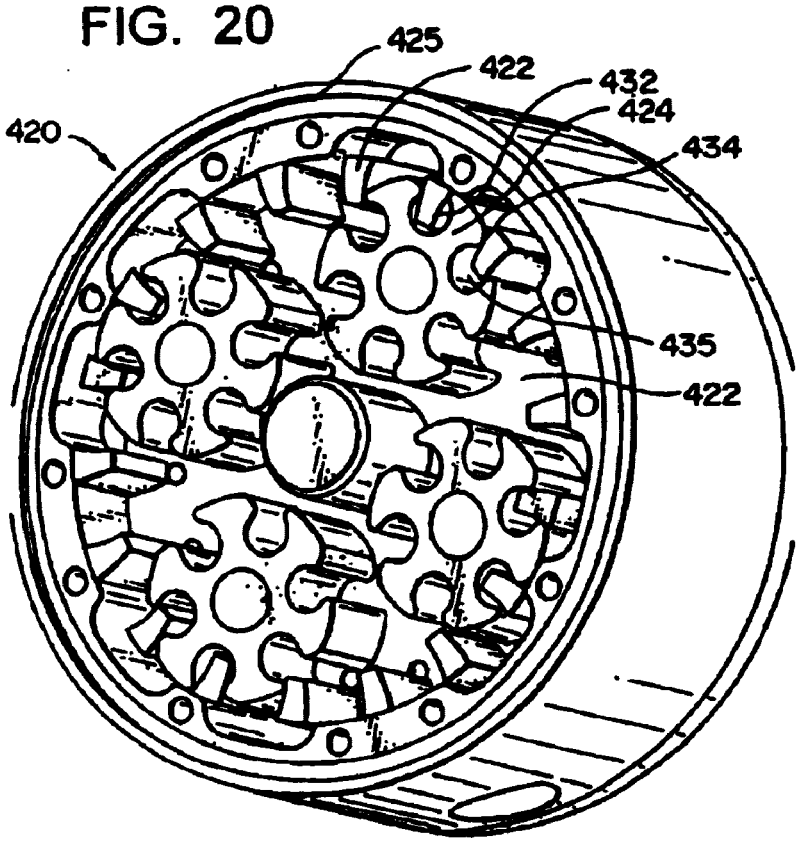
FIG. 20 is an isometric view showing a modification to the embodiment in FIG. 18 where the casing provides openings for a pump configuration.
Figure 21:
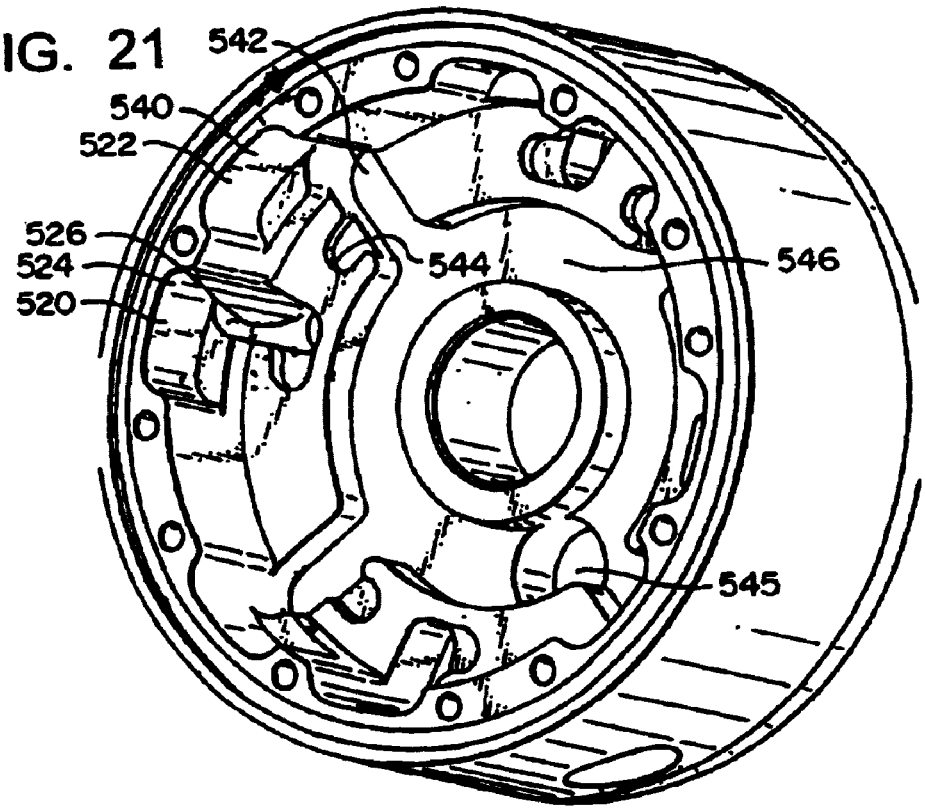
FIG. 21 is an isometric view showing the casing of the pump configuration.

FIG. 20 shows a pump version for the fourth embodiment where in general the entry and exit ports are modified to allow exit ports to be communication with any chamber that is displaced in volume to prevent compression of a fluid. The housing 425 is best shown in FIG. 21 and comprises a plurality of entrance ports 520 and exit ports 522. The entrance ports 520 comprise a radial outward slot portion 524, an axial conduit 526, and a toe portion passage 528.

The exit ports 522 comprise a radial outward slot portion 540 a radially extending slot 542 and a toe portion slot 544. The radially extending slot and toe portion slot 542 and 544 are in communication with one another and are in communication with a central annular slot region 546 which is in turn in communication to the axial conduit 548.

Figure 22:
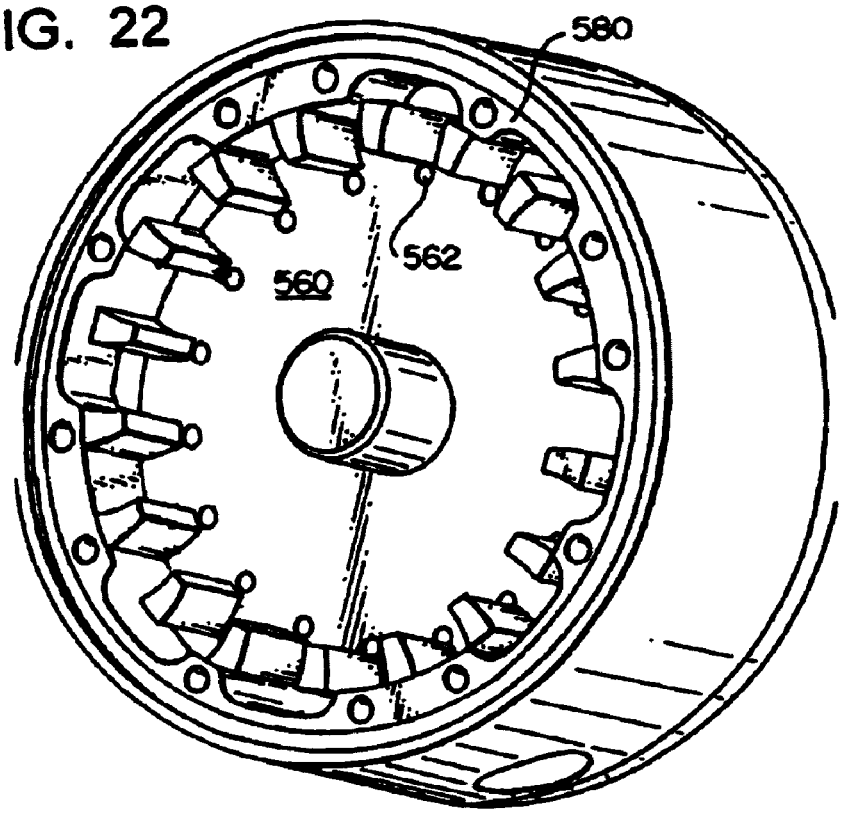
FIG. 22 is an isometric this of the pump configuration of the preferred embodiment with the outer rotor placed inside the housing.
Figure 23:
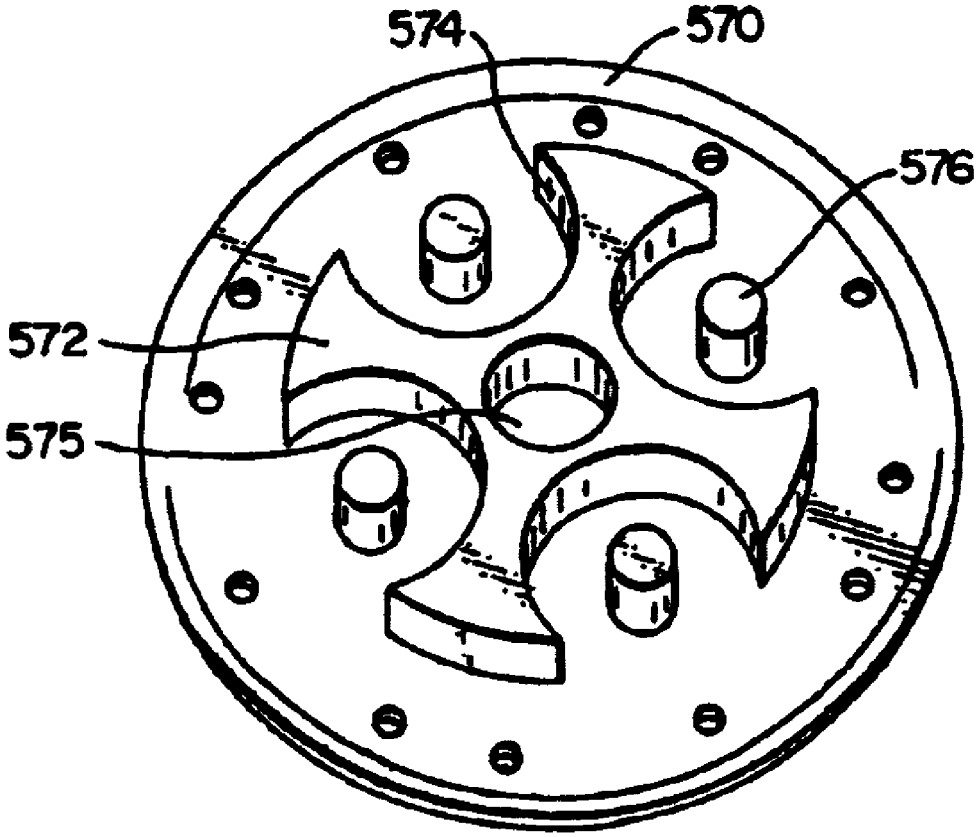
FIG. 23 is an isometric view of the end cap.

As shown in FIG. 22, the outer rotor 560 is similar to the outer rotors discussed above, with the exception a plurality of ports 562 are provided and are adapted to communicate with the toe portion passages 528. FIG. 23 shows an endcap 570 that is adapted to the mounted upon the pump assembly shown in FIG. 20. The endcap 570 has a center crossmember 572 that provides a plurality of surfaces 574 that are adapted to house the interior rotors. The extensions 576 are adapted to extend to the central shaft of the interior rotors and allowing the interior rotors to rotate their around. The central region 578 is open and allows a shaft 580 (shown in FIG. 22) pass therethrough.

The pump embodiment can be used as a flow meter as well. The multi interior rotor embodiment is particularly advantageous because the center shaft can extend therethrough and the load balance upon the shaft is desirable where the primary force upon the shaft is the torque caused by the force of the inner rotors acting upon outer rotor.

The two dimensional nature of the invention allows for variances of the geometries in the transverse direction. In other words in the transverse plane (the plane aligned in the wayword and crossword axes) at a given location in the transverse direction, the points on the inner and outer rotors 24 and 22 remain in the said plane during rotation. This is due to the axes of rotation for each rotor are parallel to each other. Therefore the geometry for the outer and inner rotors 22 and 24 can change with respects to the transverse position coordinate. To run the device in FIG. 18 as an expander the sealed chamber that is formed with a housing similar to that of the first embodiment with a gas entrance passage would receive compressed gas and provide a torque to drive the outer rotor.

There will now be a discussion of the geometric relationships between the inner and outer reference circles for the embodiments where the ratio of $r_i/r_o$ is less than ½. For this example we will assume the inner reference circle radius, $r_i$, is ⅓ of the outer reference circle, $r_o$.

Figure 24:
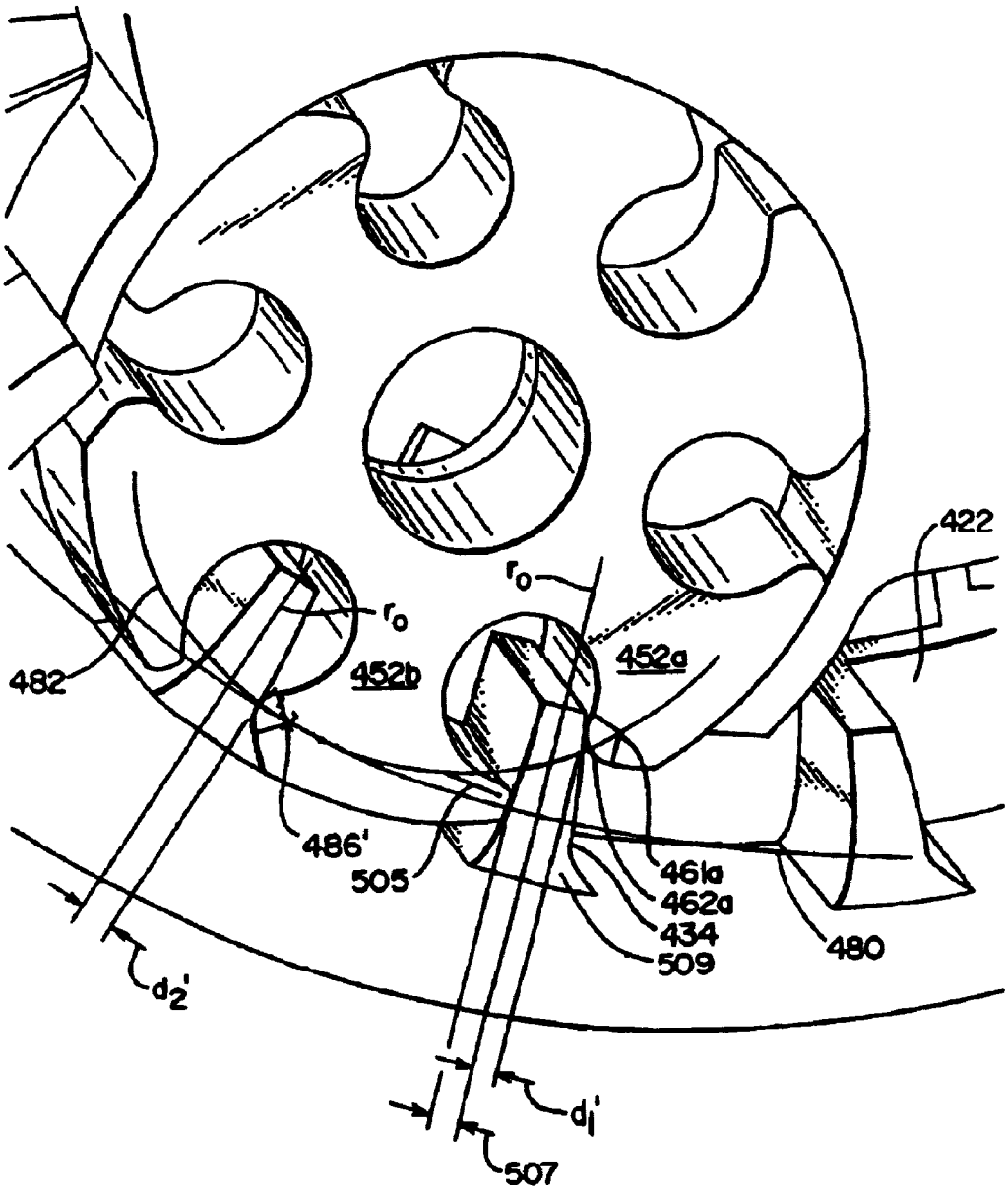
FIG. 24 is an isometric view of a close up an interior rotor of the preferred embodiment.

As shown in FIG. 24, the heel portion of 456*a* of leg 452*a* comprises a surface 462*a* that is defined as a circular surface in the transverse plane about heel point 486'. It can be seen that as the inner rotor 424 rotates to a position as leg 452*b* the engagement point of surface 462*a* is at a more distal location. Further, the perpendicular distance between the heel point 486' and the outer reference circle reference radius increases in the course of rotation (during the rotation compression phase).

Figure 25:
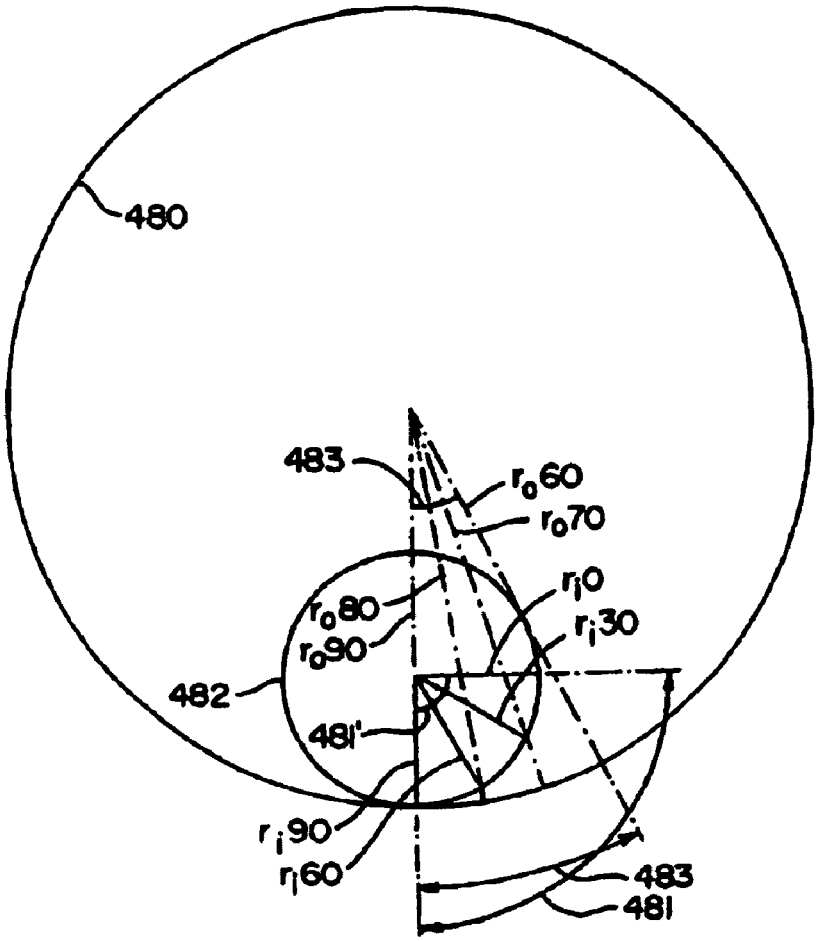
FIG. 25 is a front view showing the geometric relationship of the reference circles the inner and outer rotors.

Referring to FIG. 25, there will now be a discussion of the fundamental geometries that are used to define the engagement surfaces. FIG. 25 is similar to FIG. 9 except when the $r_i/r_o$ is not a factor of ½ then the exterior points on the inner reference circle 482 will not follow the path of the outer reference circle's radii during dual rotation (where velocity of travel is the same at the insect point as both circles rotate about their center axis. The outer reference circle 480 has a $r_o$ of three units and the inner reference circle has an inner radius of $r_i$ of one unit. Therefore the ninety degree circumferential section 481 of the inner circle 482 is equal in circumferential length to the thirty degree circumferential length 483 (see angle references 481' and 483'). For this example, four points of rotation will be examined in the clockwise direction, 0°, 30°, 60°, and 90° indicated by $r_{i\ 0}$, $r_{i\ 30}$, $r_{i\ 60}$ and $r_{i\ 90}$ for the inner rotor 482 and corresponding angles of 60°, 70°, 80° and 90° indicated by $r_{o\ 60}$, $r_{o\ 70}$, $r_{o\ 80}$ and $r_{o\ 90}$ for the outer rotor 480. The distal points of $r_{i\ 0}$, $r_{i\ 30}$, $r_{i\ 60}$ and $r_{i\ 90}$ intersect the corresponding distal points of $r_{o\ 60}$, $r_{o\ 70}$, $r_{o\ 80}$ and $r_{o\ 90}$ at the intersection location as both reference circles rotate. However, it is apparent that the corresponding radii (e.g. $r_{o\ 60}$ and $r_{i\ 0}$) do not intersect at other rotational positions at the distal point of the inner reference radius such shown in FIG. 9. Therefore it is apparent that the engagement surfaces of the heel surface 462 and the forward fin surface 434 must adapt to this varying tangential distances.

Figure 26:
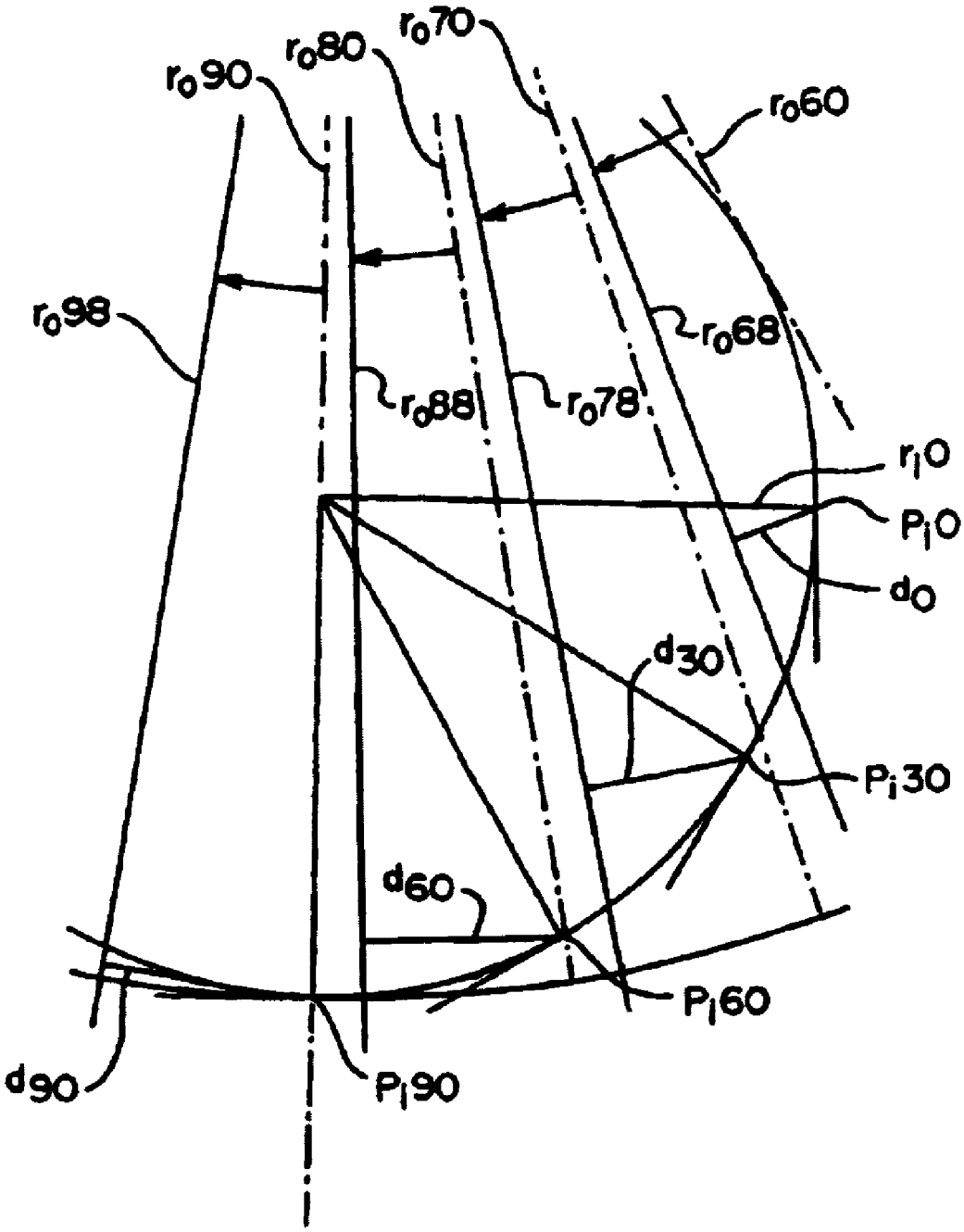
FIG. 26 is a close of the view in FIG. 25 and shows the perpendicular distance from the outer reference radii to the endpoints of the inner rotor change with respects to rotation of both reference circles while maintaining a constant velocity at the intersect point.

Now referring to FIG. 26, additional reference radial are added. For this illustrative example each outer radii $r_o$ is repositioned counter clockwise a fixed amount of degrees (e.g. 8° for this example) and numbered in the same reference degree offset fashion as $r_{o\ 68}$, $r_{o\ 78}$, $r_{o\ 88}$ and $r_{o\ 98}$. These outer circle reference radii are similar to $r_o$ as shown in FIG. 24. The perpendicular distance $d_0$ is defined as the reference radii $r_{o\ 68}$ to the distal point of $r_{i\ 0}$ indicated at $P_{i\ 0}$ and the perpendicular distances $d_{30}$, $d_{60}$ and $d_{90}$ are defined in a like fashion with reference radii $r_{o\ 78}$, $r_{o\ 88}$ and $r_{o\ 98}$ and points $P_{i\ 30}$, $P_{i\ 60}$ and $P_{i\ 90}$ respectively. It is therefore apparent that the perpendicular distances ($d_0$, $d_{30}$, $d_{60}$ and $d_{90}$) increase during the course of rotation.

Figure 27:
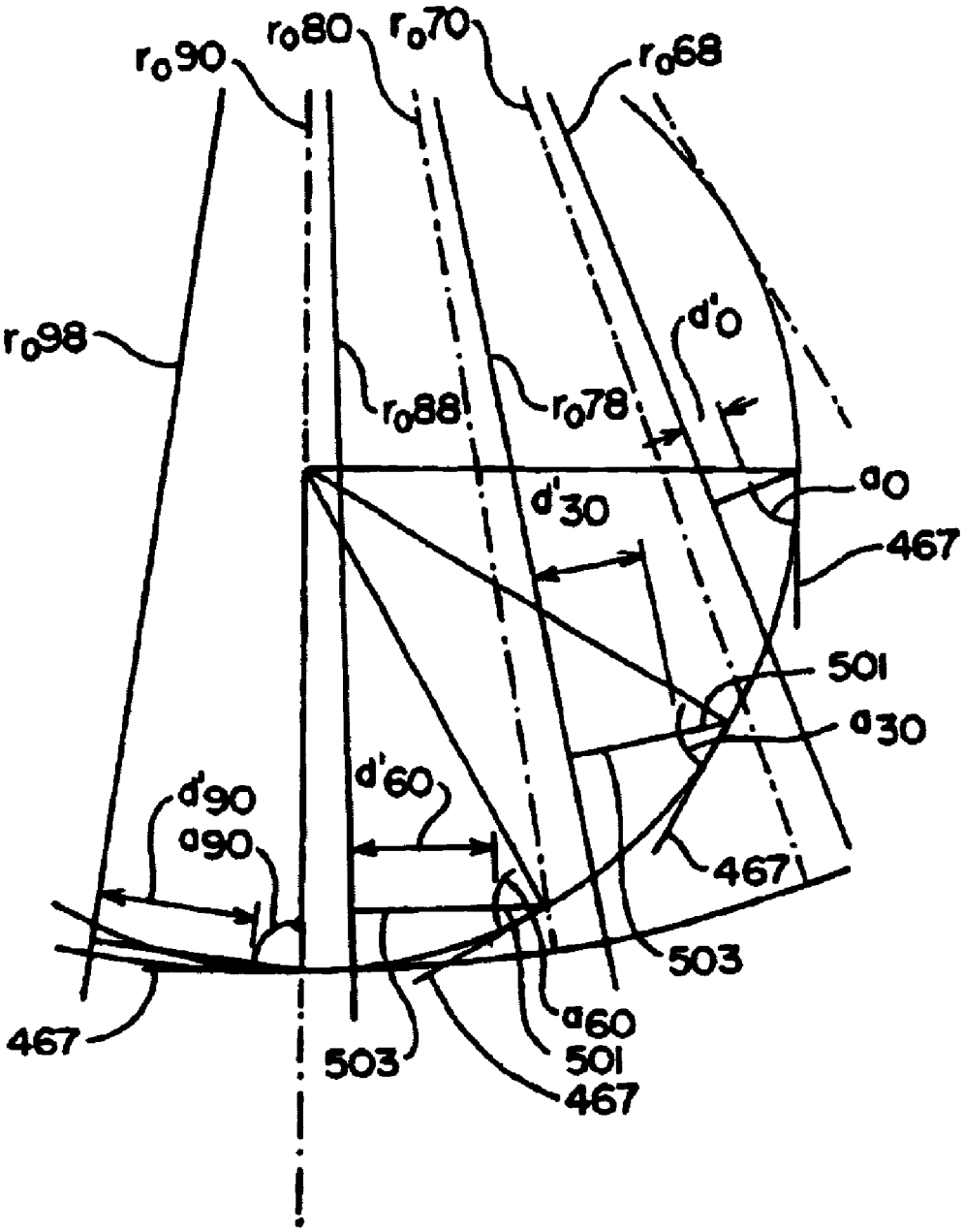
FIG. 27 shows the geometry of the preferred embodiment with the heel surface schematically shown as an arc surface.

FIG. 27 has the addition of an arc 'a' indicated at rotational positions $a_0$, $a_{30}$, $a_{60}$ and $a_{90}$. The arc is an arbitrary angle (i.e. 80°) from the tangent line 467. The arc represents the surface 462 of the leg 452 on the interior rotor 424 (see FIG. 24) It is now apparent that forward surface 434 of the outer rotor 422 must increase in distance from the reference radius $r_o$ in order to be in engagement with the surface 462. The distances $d'_0$, $d'_{30}$, $d'_{60}$, and $d'_{90}$ subtracted by the arc radius are indicated as $d_0$, $d_{30}$, $d_{60}$ and $d_{90}$ in FIG. 27. In this example the arc radius in the course of rotation 501 is referred to as the first defined distance of the heel region. The first defined distance 503 of the first fin is collinear to distance 501 and the two are vectors that add up to the distances d'. Of course d (e.g. $d_0$, $d_{30}$, $d_{60}$ and $d_{90}$) changes with respects to the radial location along the first outer reference radius $r_0$ (shown at positions $r_{o\ 68}$, $r_{o\ 78}$, $r_{o\ 88}$ and $r_{o\ 98}$ in FIG. 27). Therefore sum of 501 and 503 changes with respects to rotation of the inner and outer rotors and the distances 501 and 503 plus and desired gap width must have a sum that is equal to the perpendicular distance d whether distance 501 is constant with respects to the angle between reference line 467 or not constant. This analysis is further relevant to the surfaces of the toe region discussed below. It should be reiterated that the subscript notations are the angle of rotation of the inner rotor (where 0° is to the right in the wayward axis direction and clockwise rotation is positive).

Figure 24A:
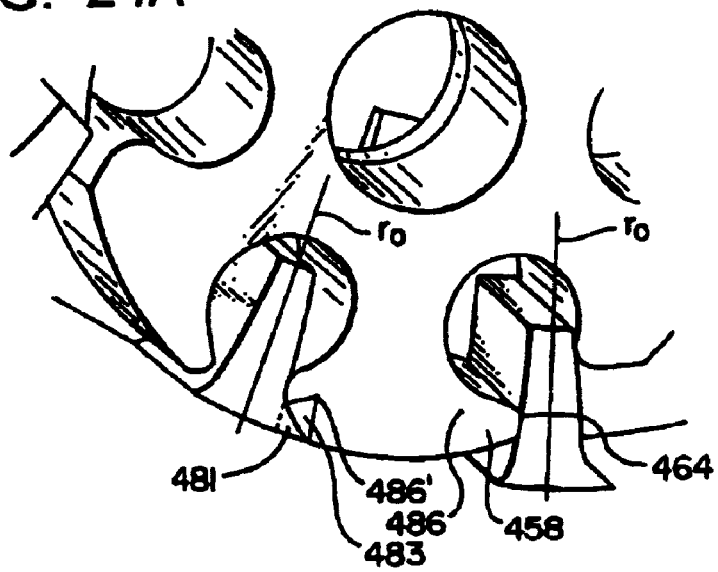
FIG. 24*a* is a second isometric view of the interior rotor engaging the fins of the exterior rotor.

Now referring back to FIG. 24, it should be noted that distance $d'_1$, is greater than $d'_2$. The point 486' is near the bottom dead center portion of rotation. The point 486' will continue to travel along the inner reference circle path 482 away from the outer reference circle 480. Therefore as shown in FIG. 24*a*, an extension region 481 is provided that is adapted to engage the outer surface indicated at the portion 483. This extension region further supplies an additional advantage by increasing the compression ratio of the device.

It should be noted that the inner reference radius $r_{,i0}$ is primarily for exemplary purposes of an extreme location because of the difficulty of having a fin extend radially inwardly to engage the arc at that rotational position.

Figure 28:
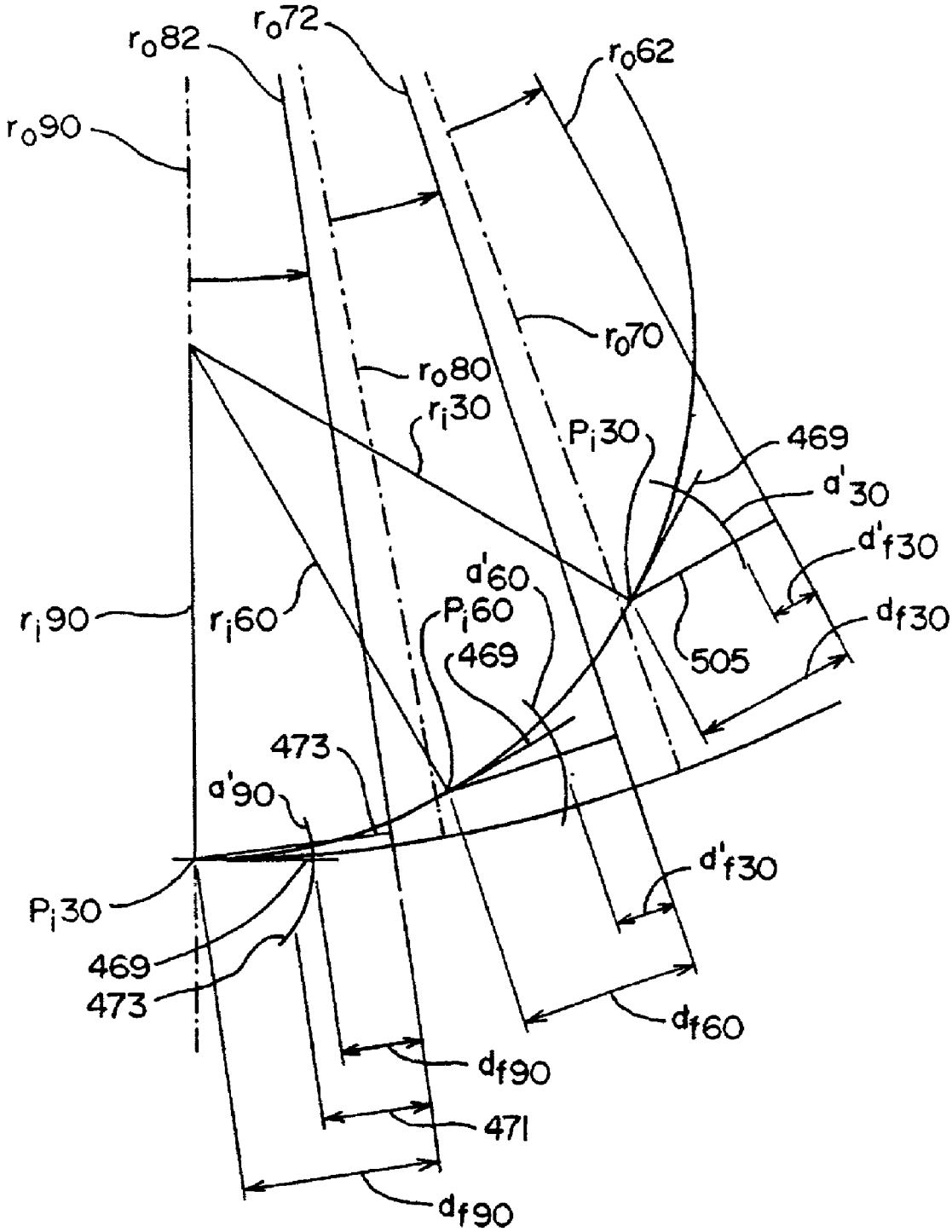
FIG. 28 shows the geometric relationship with the forward surface of the toe region and the reference axis of the outer rotor that extends through an outer rotor fin.
Figure 29:
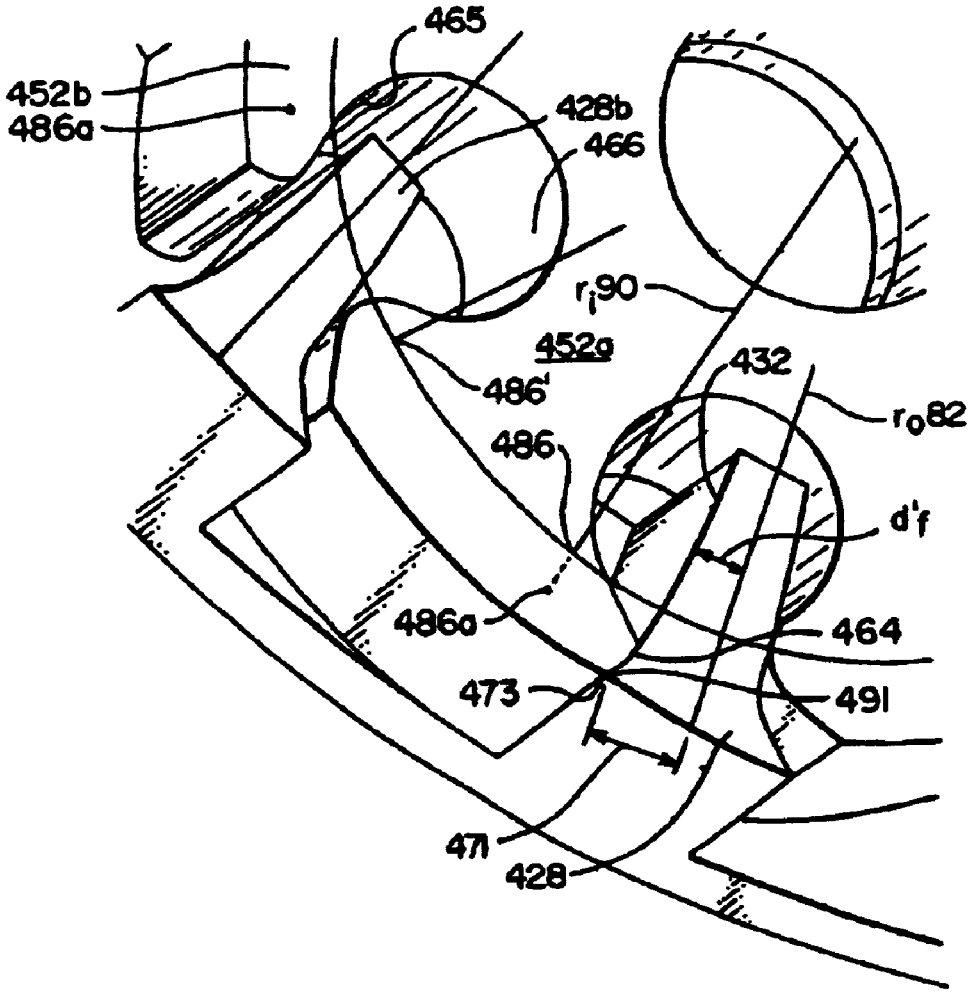
FIG. 29 shows an isometric view of a foot region of an inner rotor and the surface of a fin that is adapted to engage the surface of the toe region of the foot.
Figure 30:
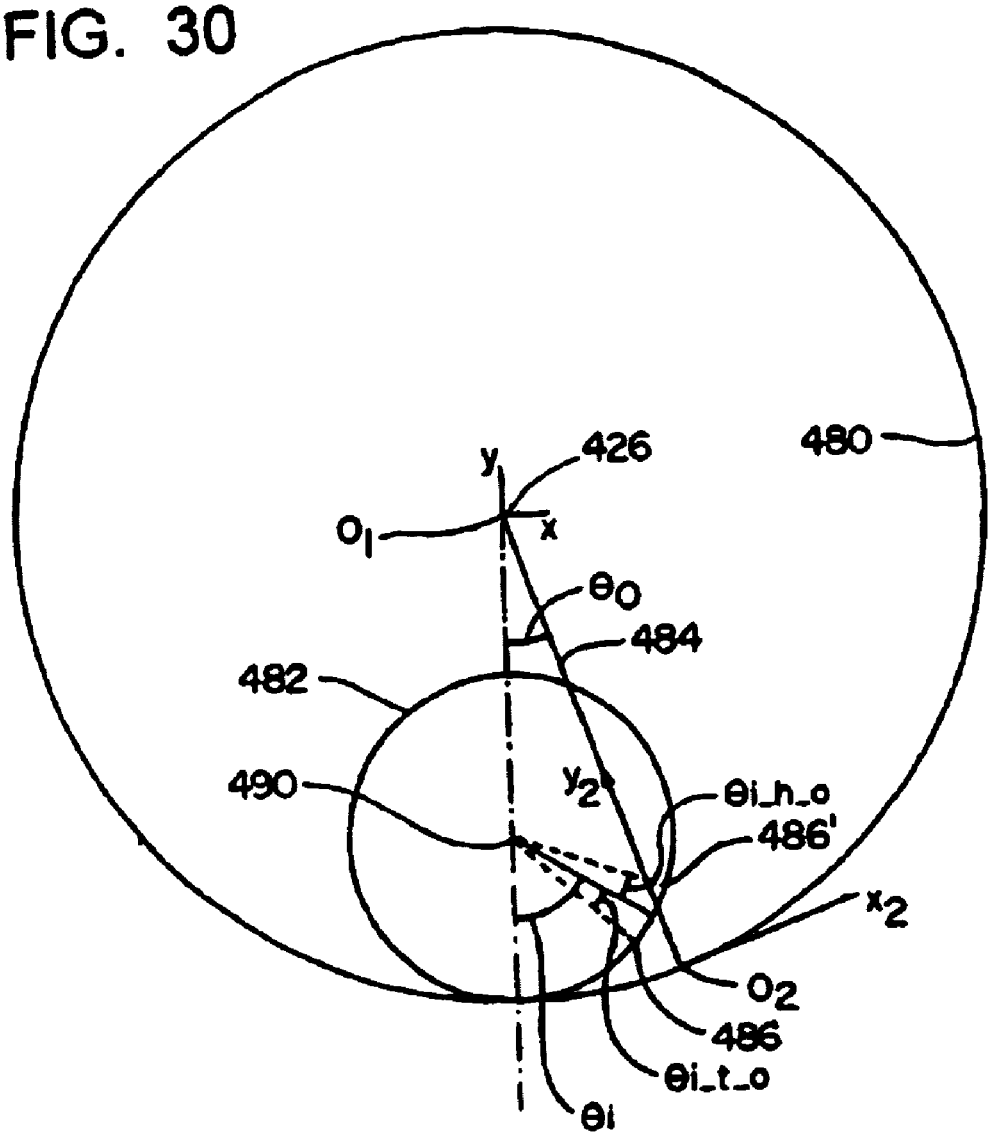
FIG. 30 is a front view of the outer and inner reference circle showing various variables that are used to mathematically define the first and second surfaces of the fins.

There will now be a discussion of the engagement surface 464 of the toe region 458 with reference to FIG. 28. The toe region arc at the positions indicated at $a'_{30}$, $a'_{60}$ and $a'_{90}$ are centered about points $P_{i\ 30}$., $P_{i\ 60}$. $P_{i\ 90}$ respectively. The indicator lines 469 are ninety degrees from the inner radius reference lines $r_i$ and are helpful for determining the angle of the orthogonal distances $d_f$. The orthogonal distances $d_{f30}$, $d_{f60}$ and $d_{f90}$ increase as the rotors rotate clockwise to the 90 degree position and the $d'_{f30}$, $d'_{f60}$ and $d'_{f90}$ that are defined as the orthogonal distances $d_{f30}$, $d_{f60}$ and $d_{f90}$ subtracted by the arc radius of arcs a' in FIG. 28. It can be observed that the distances $d'_{f30}$, $d'_{f60}$ and $d'_{f90}$ increase with clockwise rotation. The arc represents the engagement surface 464 as shown in FIGS. 24*a* and 29. Therefore with an arc that has a constant radius, the second defined distance $d'_f$ as shown in FIG. 29 increases with respects to the radial location along the second reference radius shown at $r_{o82}$ and the engagement surface 432 of the fin 428 in FIG. 29 must increase in distance from the outer reference radius $r_{o82}$ with respects to radially outward travel along $r_{o82}$.

Therefore as the perpendicular distance $d_f$ changes with respects to the rotational position of the inner and outer rotors, the second defined distance 505 of the toe region is collinear with the second defined distance 507 ($d'_f$) of the second fin 509 and their sum plus a desired gap totals the distance $d_f$ that changes with respects to the rotational position of the inner and outer rotors. This relationship is similar to the analysis of the heel region.

The distance 471 in FIGS. 28 and 29 roughly indicates the location and magnitude of increased tangential distance between $r_{o82}$ and the distal portion of surface 432. This accelerated increase in distance is because as seen in FIG. 28 the orthogonal line 473 is above the ninety degree reference line 469 and indicates the shortest path from the reference point 486 to $r_{o82}$. However, for clearance among the parts it is advantageous extend the material at extension portion 491 to engage the outer region 473 of the surface 464.

Therefore a preferred method of constructing the first and second surfaces 434 and 432 is sketch out a CAD drawing such as that in FIGS. 27 and 28 and rotate the inner circle 3 units and the outer circle 1 unit (the aspect ratio to $r_o/r_i$) and enter in spline points that traces the path of the forward and rearward (second and first) fin surfaces with a desirable gap or interference fit thereinbetween. Then the inner chamber 435 (FIG. 20) should be constructed in a manner to not interfere with the fin during rotation.

To use the preferred embodiment as an expander the exit port is an entrance port and the fluid will fill the expanding sealed chamber. The preferred embodiment (shown in FIG. 18) could be used in conjunction with the first embodiment for the external combustor engine. The first embodiment would provide the compression stage and receive some expanding gas from the combustor to help drive the outer rotor and the remainder of gas can be directed to expanding sealed chambers of the fourth embodiment for torque to drive the compression stage and for work output.

It is therefore apparent that the preferred embodiment utilizes nonlinear surfaces in the radial direction of the fins. It is important to note the desirable balancing loads radial loads upon the outer rotor when a plurality of inner rotors are employed. Further, a center throughput shaft can be attached to the outer rotor in the preferred embodiment.

The preferred embodiment as shown in FIGS. 18–29 can be used with a gas expander in a similar manner as shown in FIGS. 12, 14, and 15 with the routing of gas from the housing 225 to and from the combustor. The preferred embodiment could further be used as a positive displacement flow meter where the volume displacement per revolution is a known value and a rotational counter is used to measure the flow rate or total flow.

The mathematical model to define the surfaces of the fin is discussed below with reference to FIGS. 31–33.

To ease the explanation the first and second surfaces (heel and toe surfaces of the fin will be defined using two coordinate systems $O_1$ and $O_2$. The first coordinate system is referenced to the casing and is located at the center of rotation of the outer reference circle 480 of the outer rotor. Because we are interested in defining the surfaces of a fin of the outer rotor, a second coordinated system is defined at $O_2$ and the Y axis of the second coordinate system extends radially inward along the reference radius 484 which is the reference radius that extends through a point through the fin to be defined.

The relationship between the rotational value θo of the reference circle to the rotational value θi of the inner reference circle is defined by the equation:

$$\theta o = \frac{\theta i Ri}{Ro}$$

The angular location of the center of the heel arc 462' and the toe arc 464' are denoted by θh and θt where each point 486 and 486' are rotationally offset from point 450 by a value θi_t_o for the toe region and θi_h_o for the heel region. These offsets represents the distance the points 486 and 486' are from the center radius 484 of the fin to be defined. Therefore the resulting equations are:

$$\theta t = \theta i - \theta i_t_o$$

$$\theta h = \theta i + \theta i_h_o$$

The position of the toe center point 486 with respects to the first axis $O_1$ are defined by x,y coordinates Xi_t and Yi_t where Rip_t is the distance from the inner circle center point 450. As shown in FIGS. 31*a*–31*d* the points 486 and 486' lie on the circumference of the outer reference circle. However, as shown in FIG. 32 the points 486 and 486' can be extended beyond the inner reference circle to define the first and second surfaces (heel and toe fin surfaces) 462' and 464':

$$Xi_t = \sin(\theta t) Rip_t$$

$$Yi_t = -\cos(\theta t) Rip_t - ro + ri$$

In a similar manner the position of the heel center point 462' in the first axis $O_1$ coordinate system is defined by the equations:

$$Xi_h = \sin(\theta h) Rip_h$$

$$Yi_h = -\cos(\theta h) Rip_h - ro + ri$$

The x,y location of the second origin O2 in the first coordinate system is defined as:

$$Xo := \sin(\theta o) Ro$$

$$Yo := -\cos(\theta o) Ro$$

The second coordinate system $O_2$ is referenced to the center axis 484 of a fin of the outer rotor. Therefore the second coordinate system changes position with respects to the first coordinate system during rotation of the inner and outer reference circles (corresponding to rotation of the inner and outer rotors). To convert from the first coordinate system $O_1$ to the second coordinate system $O_2$ the following functions are used.

$$fx2 := (x,y) \rightarrow (x - Xo)\cos(\theta o) + (y - Yo)\sin(\theta o)$$

$$fy2 := (x,y) \rightarrow (y - Yo)\cos(\theta o) - (x - Xo)\sin(\theta o)$$

Therefore, the arc center points 486 and 486' in the second (fin) coordinate system are:

$$Xi_t2 := fx2(Xi_t,\ Yi_t)$$

$$Yi_t2 := fy2(Xi_t,\ Yi_t)$$

and $$Xi_h2 := fx2(Xi_h,\ Yi_h)$$

$$Yi_h2 := fy2(Xi_h,\ Yi_h)$$

which are expanded to the format:

$$Xi_t2 := (\sin(\theta t) Rip_t - \sin(\theta o) Ro)\cos(\theta o) + (-\cos(\theta t) Rip_t - ro + ri + \cos(\theta o) Ro)\sin(\theta o)$$

$$Yi_t2 := (-\cos(\theta t) Rip_t - ro + ri + \cos(\theta o) Ro)\cos(\theta o) - (\sin(\theta t) Rip_t - \sin(\theta o) Ro)\sin(\theta o)$$

and for the heel center point 486'

$$Xi_h2 := (\sin(\theta h) Rip_h - \sin(\theta o) Ro)\cos(\theta o) + (-\cos(\theta h) Rip_h - ro + ri + \cos(\theta o) Ro)\sin(\theta o)$$

$$Yi_h2 := (-\cos(\theta h) Rip_h - ro + ri + \cos(\theta o) Ro)\cos(\theta o) - (\sin(\theta h) Rip_h - \sin(\theta o) Ro)\sin(\theta o)$$

Finally the offset from the center point 486 to the center fin axis in the second coordinate system axis is defined as the equations:

$$Xf_t := Xi_t2 + r_t + gap_t$$

$$Yf_t := Yi_t2$$

The above equations are for the toe surface where r_t is the radius or radius function for the toe surface arc and gap_t is the gap clearance distance or function to account for a fluid film gap. The expanded full form of the equations are:

$$Xf_t := (\sin(\theta t)Rip_t - \sin(\theta o)Ro)\cos(\theta o) + (-\cos(\theta t)Rip_t - ro + ri + \cos(\theta o)Ro)\sin(\theta o) + r_t + gap_t$$

$$Yf_t := (-\cos(\theta t)Rip_t - ro + ri + \cos(\theta o)Ro)\cos(\theta o) - (\sin(\theta t)Rip_t - \sin(\theta o)Ro)\sin(\theta o)$$

Likewise for the heel surface, the equation to determine the perpendicular distance from the center point 486' to the heel surface is defined as:

$$Xf_h := Xi_h2 - r_h - gap_h$$

$$Yf_h := Yi_h2$$

and the expanded forms are:

$$Xf_h := (\sin(\theta h)Rip_h - \sin(\theta o)Ro)\cos(\theta o) + (-\cos(\theta h)Rip_h - ro + ri + \cos(\theta o)Ro)\sin(\theta o) - r_h - gap_h$$

$$Yf_h := (-\cos(\theta h)Rip_h - ro + ri + \cos(\theta o)Ro)\cos(\theta o) - (\sin(\theta h)Rip_h - \sin(\theta o)Ro)\sin(\theta o)$$

Substituting in the variables for θh and θo we get the equations:

$$\begin{aligned}
\text{Xi_t2} := {} & \left(\sin(\theta i - \theta i_t_o)\text{rip_t} - \sin\left(\frac{\theta iRi}{Ro}\right)ro\right)\cos\left(\frac{\theta iRi}{Ro}\right) + \\
& \left(-\cos(\theta i - \theta i_t_o)\text{rip_t} - ro + ri + \cos\left(\frac{\theta iRi}{Ro}\right)ro\right)\sin\left(\frac{\theta iRi}{Ro}\right) \\
\text{Yi_t2} := {} & \left(-\cos(\theta i - \theta i_t_o)\text{rip_t} - ro + ri + \cos\left(\frac{\theta iRi}{Ro}\right)ro\right)\cos\left(\frac{\theta iRi}{Ro}\right) - \\
& \left(\sin(\theta i - \theta i_t_o)\text{rip_t} - \sin\left(\frac{\theta iRi}{Ro}\right)ro\right)\sin\left(\frac{\theta iRi}{Ro}\right) \\
\text{Xi_h2} := {} & \left(\sin(\theta i + \theta i_h_o)\text{rip_h} - \sin\left(\frac{\theta iRi}{Ro}\right)ro\right)\cos\left(\frac{\theta iRi}{Ro}\right) + \\
& \left(-\cos(\theta i + \theta i_h_o)\text{rip_h} - ro + ri + \cos\left(\frac{\theta iRi}{Ro}\right)ro\right)\sin\left(\frac{\theta iRi}{Ro}\right) \\
\text{Yi_h2} := {} & \left(-\cos(\theta i + \theta i_h_o)\text{rip_h} - ro + ri + \cos\left(\frac{\theta iRi}{Ro}\right)ro\right)\cos\left(\frac{\theta iRi}{Ro}\right) - \\
& \left(\sin(\theta i + \theta i_h_o)\text{rip_h} - \sin\left(\frac{\theta iRi}{Ro}\right)ro\right)\sin\left(\frac{\theta iRi}{Ro}\right)
\end{aligned}$$

to have the x,y values be a function of the θi (the inner rotation of the inner reference circle.

The new variables r_h and gap_h represent the radius of the heel arc and the desired gap distances (or equations of they vary with respects to rotation).

With the forgoing in mind there will now be a final discussion regarding the mathematical model for defining the first and second surfaces with reference to FIGS. 31*a*–31*d*. In general these figures illustrate the progressive formation of the first (heel) and second (toe) surfaces. The frame of reference for the FIGS. 31*a*–31*d* is the central axis 484 of the fin. The center axis of the fin can be at any number of rotational positions with respects to points 486 and 486' and preferably between the two points. The arcs 462' and 464' are shown as complete circles; however, only a portion of the arcs 462' and 464' are used to define the engagement surfaces of the foot of the rotor in the fourth embodiment (see FIGS. 24 and 29).

Figure 31A:
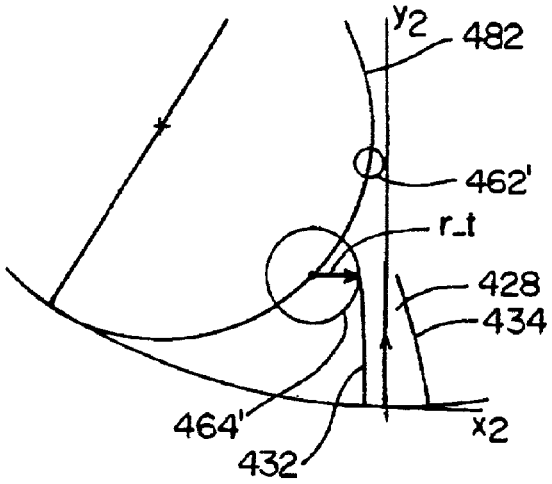
FIGS. 31*a*–31*d* shows the progression of rotation of the inner and outer reference circles where the heel and toe arcs define the first and second surfaces of the fin.

Now referring to FIG. 31*a*, the toe arc radius r_t is greater than the arc radius r_h for the heel arc surface. This is because it is desirable to have a larger arc radius for the toe region so the foot and use the lower portion of the arc for the engagement surface (see FIG. 29) so the foot can clear the fin on the entrance phase of rotation.

Figure 31B:
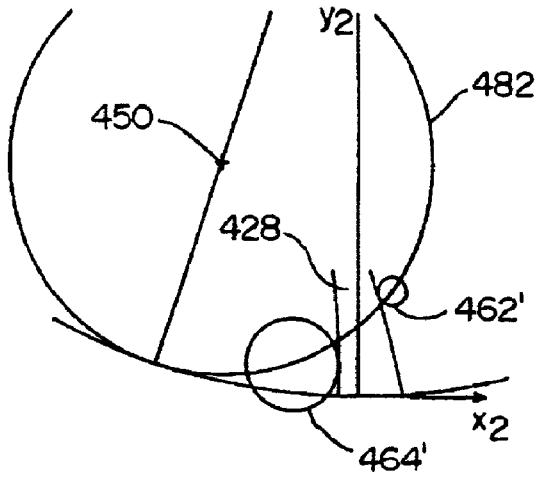
Figure 31C:
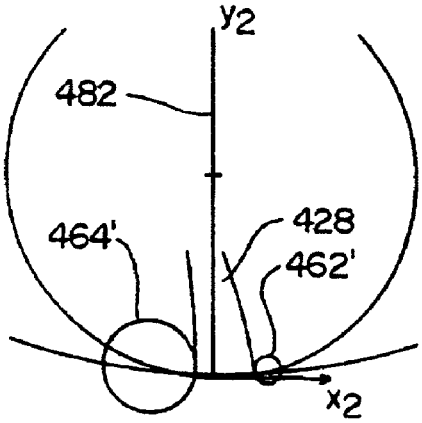
Figure 31D:
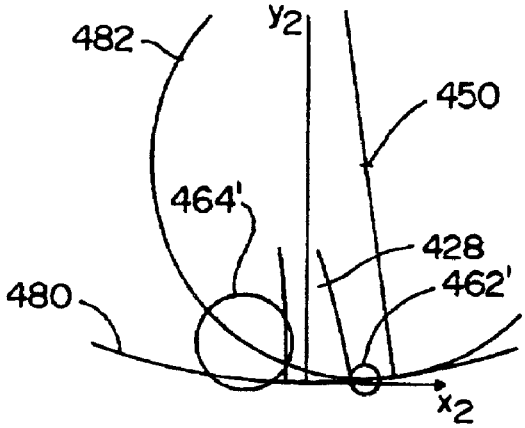

FIG. 31*b* shows the surfaces now with the inner reference circle 482 rotated positively approximately 20–30 degrees clockwise. Now both arcs 462' and 464' are engaging the surfaces 434 and 432 respectively. This figure illustrates how the present invention allows for engagement to occur between the inner and outer rotor for more than a single point or rotation. In other words, the surfaces that are defined by the arcs 462' and 464' will engage the surface of either side of the fin for a rotational period or duration (i.e. a rotational range such as thirty degrees of rotation of the inner rotor). As shown in FIG. 31*c* where the rotation of the outer radius 482 is at bottom dead center the arcs are still in engagement; however, as shown in FIG. 31*d* the toe arc 464' is beginning to interfere with the surface. Now referring back to FIG. 29 it is shown that the foot 452*b* is just clearing the fin 428*b*. As discussed above second engagement surface 464 of the toe only uses the lower portion of the arc 464' because as seen in FIG. 31*d* if the upper portion is used it will interfere with the fin 428.

Figure 32:
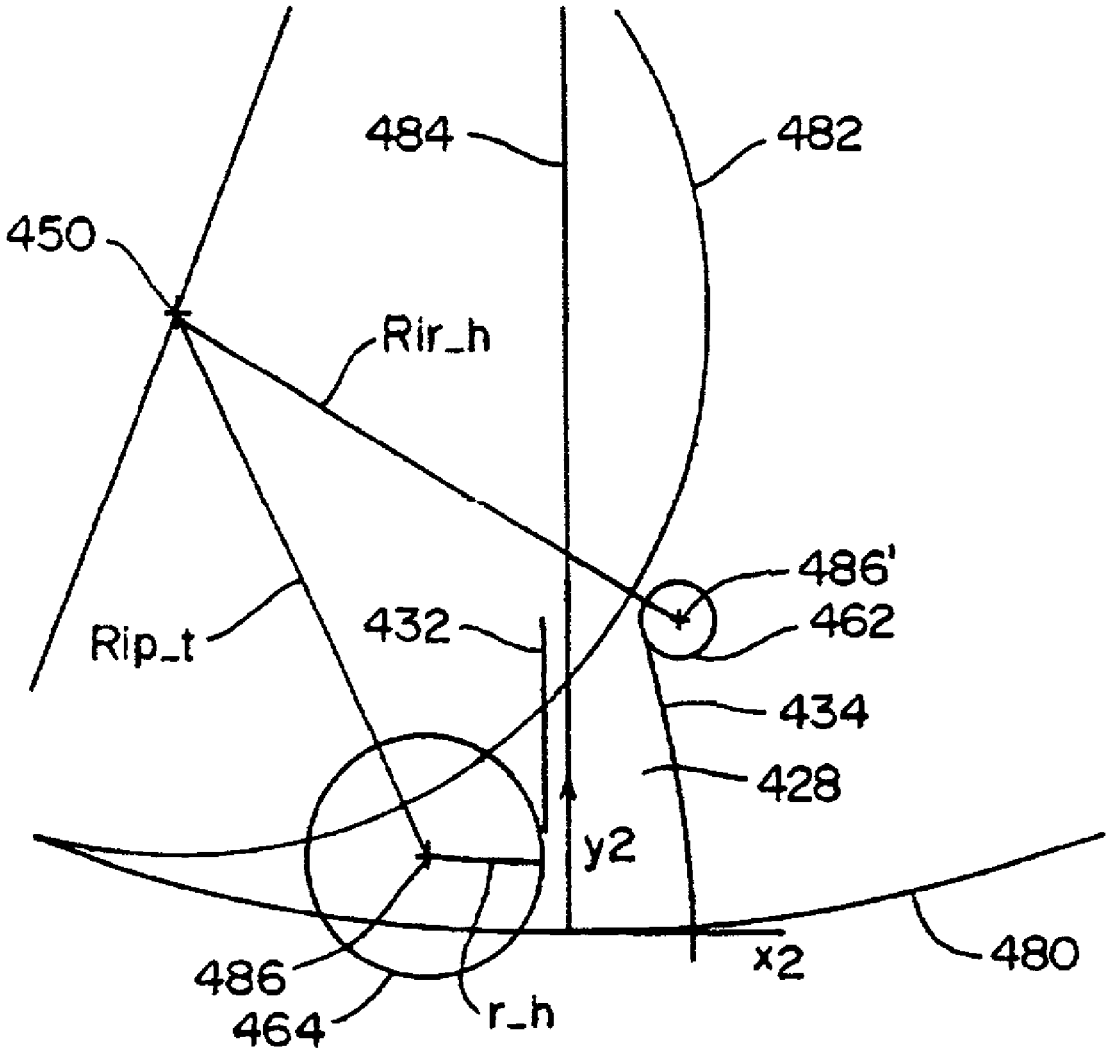

Now referring to FIG. 32, it is shown that the first and second surfaces 434 and 432 can be created by having the center points 486 and 486' at a radial distance Rip_t and Rip_h from the center point 450 greater than the radius of the inner circle. Referring to FIG. 29, changing the value of Rip_t to shift the arc center point to a location such as 486*a* can be helpful for creating the an arc that is at a better location to allow more room for clearance between the inner surface 465 and the fin 428*b*. It is important to note that the inner surfaces 465 and 466 should be construed in a manner to clear the fins 428 during the entire course of rotation of the inner and outer rotors.

It should be noted that the preferred embodiment allows for points of contact between the toe second engagement surface and the second surface of a second fin and first engagement surface of the heel and the first surface of an adjacent fin for a more than an instant point of rotation. The sealed chamber is in effect for more than a finite range of rotation (i.e. certain amount of rotation of the inner and outer rotors). In other words a sealed chamber is maintained for up to 45° of rotation of the inner rotor and possibly higher with longer thinner fins extending radially inwardly.

Therefore it is apparent that the device has numerous applications for converting energy (e.g. applied torque to create a pressure differential and vice versa). While the invention is susceptible of various modifications and alternative forms, specific embodiments thereof have been shown by way of example in the drawings and described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

Whereas I claim:

1. A device to convert energy by displacing fluid, the device comprising:

an outer rotor adapted to rotate about a first axis of rotation and comprising a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin and a second surface of said second fin, and the number of the chambers indicated by variable X, the outer rotor further comprising an outer reference dimension circle that is concentric with said first axis of rotation of the said outer rotor and the outer reference dimension circle having a radius $r_o$;

a plurality of inner rotors adapted to rotate about a set of second axes of rotation where each inner rotor comprises an inner reference circle that is concentric with the second axis of rotation of the inner rotor and intersecting the outer reference circle of said outer rotor at an intersect point where the velocity of the inner rotor and outer rotor are the same at said intersect point, the inner reference circle having a radius $r_i$, the inner rotors further each comprise a plurality of legs the number of said legs is indicated by variable Λ where a first leg that is a member of said legs comprises a foot region the foot region comprising:

a radially outward surface;

a heel region comprising a first reference point that is adapted to rotate with the inner reference circle where said first reference point is non constant perpendicular distance from said first reference radius of the outer reference circle with respects to rotation of the inner and the outer rotor, and the heel region further comprising a first engagement surface adapted to engage the first surface of said first fin, a toe region comprising a second reference point that is positioned on said inner reference dimension circle, a second engagement surface that is adapted to engage the second surface of the second fin; and a casing having an inner chamber region that is adapted to house said outer rotor and allow the outer rotor to rotate therein, the casing comprising:

a fluid entrance system comprising a duct to communicate with the chamber region of said outer rotor, and an interior cavity adapted to house said inner rotor, whereas the said variables Λ, X, $r_i$, $r_o$ are constrained by the equation $\Lambda/X=r_i/r_o$, the foot region of said first leg is adapted to engage the chamber region where the first engagement surface of said heel region engages said first surface of a first fin and said second engagement surface of said toe region of said first foot is adapted to engage the second surface of a second fin to form a sealed operating chamber where rotation of said inner rotor and said outer rotor causes displacement of fluid in the sealed operating chamber a finite range of rotation; and wherein the casing comprises a gas entrance channel that is adapted to receive a gas and the sealed operating chamber operates as a gas compression chamber that is adapted to compress gas and be discharged through an exit channel and the exit channel has an adjustment system to adjust the compression ratio of the compressed gas.

2. The device as recited in claim 1 where a porting of the casing is adapted to allow non compressible fluid to enter said chamber region and the casing comprising a discharge port in communication with the sealed operating chamber as the volume of fluid is displaced.

3. The device as recited in claim 1 where the ratio of $r_i/r_o$ is less than ½.

4. The device as recited in claim 3 where ratio of $r_i/r_o$ is an integer value.

5. The device as recited in claim 1 where the casing comprises a gas expansion region and a gas inlet port that is in communication with a gas expansion chamber that is defined by first and second surfaces of two adjacent fins and said first foot where the chamber is adapted to receive expanding gas that applies a torque to the outer rotor.

6. The device as recited in claim 5 where ratio of $r_i/r_o$ is less than ½.

7. A device to convert energy by displacing fluid, the device comprising:

an outer rotor adapted to rotate about a first axis of rotation and comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

a plurality of inner rotors each adapted to rotate about a second set of axes of rotation and each inner rotor comprising an inner reference circle that is concentric with the axis of rotation of each inner rotor and each inner reference circle intersecting the outer reference circle of said outer rotor at an intersect point where the velocity of the inner rotor and outer rotor are the same at the said intersect points, the inner reference circles each having a radius $r_i$, the inner rotors further each comprising a plurality of legs the number of said legs for each inner rotor is indicated by variable Λ where a first leg that is a member of said legs comprises a foot region the foot region comprising:

a heel region comprising a first reference point that is adapted to rotate with said first reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor, a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor; and a casing having an inner chamber region that is adapted to house said outer rotor and allow the outer rotor to rotate therein, the casing comprising;

a fluid entrance system comprising a duct to communicate with the chamber region of the said outer rotor, and an interior cavity adapted to house said inner rotors and allow the inner rotors to rotate therein, whereas the said variables $\Lambda$, X, $r_i$, $r_o$ are constrained by the equation $\Lambda/X=r_i/r_o$, the foot region of said first leg is adapted to engage the chamber region where the first engagement surface of said heel region engages said first surface of a first fin and said second engagement surface of said toe region of said first foot is adapted to engage the second surface of a second fin to form a sealed operating chamber where rotation of said inner rotor and said outer rotor causes displacement of fluid in the sealed operating chamber, and whereas the casing comprises a gas entrance channel that is adapted to receive a gas and the sealed operating chamber operates as a gas compression chamber that is adapted to compress gas and be discharged through an exit channel and the exit channel has an adjustment system to adjust the compression ratio of the compressed gas.

8. The device as recited in claim 1 where a porting of the casing is adapted to allow non compressible fluid to enter said chamber region and the casing comprising a discharge port in communication with the sealed operating chamber as the volume of fluid is displaced.

9. The device as recited in claim 1 where the ratio of $r_i/r_o$ is less than ½.

10. The device as recited in claim 1 where the casing comprises a gas expansion region and a gas inlet port that is in communication with a gas expansion chamber that is defined by first and second surfaces of two adjacent fins and said first foot where the chamber is adapted to receive expanding gas that applies a torque to the outer rotor.

11. The device as recited in claim 4 where the ratio of $r_i/r_o$ is less than ½.

12. The device as recited in claim 1 where the ratio of $r_i/r_o$ is an integer value.

13. The device as recite in claim 1 where the gas is air.

14. A device to convert energy by displacing fluid, the device comprising:

an inner rotor adapted to rotate about a second axis of rotation where the inner rotor comprises an inner reference circle that is concentric with the second axis of rotation of the inner rotor the inner reference circle having a radius $r_i$, the inner rotor further comprise a plurality of legs where a first leg that is a member of said legs comprises a foot region the foot region comprising;

a radially outward surface;

a heel region comprising a first reference point that is positioned on a distance defined as Rip_h from the second axis at a rotational position θh and the heel region further comprising a first engagement surface that is an arc distance r_h from said first reference point, a toe region comprising a second reference point that is positioned a distance defined as Rip_t from said second axis at a rotational position θt, a second engagement surface that is a radius distance r_t from said second reference point, an outer rotor adapted to rotate about a first axis of rotation and comprising an outer reference dimension circle that is concentric with said first axis of rotation of the said outer rotor and the outer reference dimension circle having a radius $r_o$ and the outer rotor comprising;

a first and second fin each comprising a first reference radius at a rotational location θo that extends through the first fin, a first surface of said first fin a distance defined by gap_h from said first engagement surface and having orthogonal coordinates Xf_h, Yf_h from an origin point located on said first reference radius where Xf_h and Yf_h are defined by $$Xf_h:=(\sin(\theta h)Rip_h-\sin(\theta o)Ro)\cos(\theta o)+(-\cos(\theta h)Rip_h-ro+ri+\cos(\theta o)Ro)\sin(\theta o)-r_h-gap_h$$

$$Yf_h:=(-\cos(\theta h)Rip_h-ro+ri+\cos(\theta o)Ro)\cos(\theta o)-(\sin(\theta h)Rip_h-\sin(\theta o)Ro)\sin(\theta o)$$

a second surface defined by orthogonal coordinates Xf_t and Yf_t from said origin where the distance between the said second surface and the second engagement surface is defined by distance, gap_t where the values Xf_t and Yf_t are defined by $$Xf_t:=(\sin(\theta t)Rip_t-\sin(\theta o)Ro)\cos(\theta o)+(-\cos(\theta t)Rip_t-ro+ri+\cos(\theta o)Ro)\sin(\theta o)+r_t+gap_t$$

$$Yf_t:=(-\cos(\theta t)Rip_t-ro+ri+\cos(\theta o)Ro)\cos(\theta o)-(\sin(\theta t)Rip_t-\sin(\theta o)Ro)\sin(\theta o)$$

a casing having an inner chamber region that is adapted to house said outer rotor and allow the outer rotor to rotate therein, the casing comprising;

a fluid entrance system comprising a duct to communicate with the chamber region of the said outer rotor, an interior cavity adapted to house said inner rotor, whereas the θo changes at a ratio of $r_i/r_o$ of the θi value and the foot region of said first leg is adapted to engage the chamber region defined between said first and second fin where the first engagement surface of said heel region is adapted to engage said first surface of the first fin and said second engagement surface of said toe region of the said first foot is adapted to engage the second surface of the second fin to form a sealed operating chamber where rotation of said first rotor and said rotor causes displacement of fluid in the sealed operating chamber a finite range of rotation.

15. The device as recited in claim 14 where the number of legs of the inner rotor is defined by a variable $\Lambda$ and the number of chambers defined by the plurality of fins is defined by X where $\Lambda$, X, $r_i$, $r_o$ are defined by the equation $\Lambda/X=r_i/r_o$.

16. The device as recited in claim 15 where a plurality of inner rotors are employed and the fluid entrance system further comprises a duct to communicate with the each chamber region of said outer rotor that rotationally precedes the sealed chamber region of each inner rotor.

17. The device as recited in claim 16 where the sum radial force upon the outer rotor is substantially balanced.

18. The device as recited in claim 16 where the central region of the outer rotor has a drive shaft attached thereto.

19. The device as recited in claim 15 where the ratio of $r_i/r_o$ is less than ½.

20. The device as recited in claim 19 where the ratio of $r_i/r_o$ is an integer value.

21. A device to convert energy by displacing fluid, the device comprising:

an outer rotor adapted to rotate about a first axis of rotation and comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

a plurality of inner rotors each adapted to rotate about a second set of axes of rotation and each inner rotor comprising an inner reference circle that is concentric with the axis of rotation of each inner rotor and each inner reference circle intersecting the outer reference circle of said outer rotor at an intersect point where the velocity of the inner rotor and outer rotor are the same at the said intersect points, the inner reference circles each having a radius $r_i$, the inner rotors further each comprising a plurality of legs the number of said legs for each inner rotor is indicated by variable Λ where a first leg that is a member of said legs comprises a foot region the foot region comprising:

a heel region comprising a first reference point that is adapted to rotate with said first reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor, a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor; and a casing having an inner chamber region that is adapted to house said outer rotor and allow the outer rotor to rotate therein, the casing comprising;

a fluid entrance system comprising a duct to communicate with the chamber region of the said outer rotor, and an interior cavity adapted to house said inner rotors and allow the inner rotors to rotate therein, whereas the said variables Λ, X, $r_i$, $r_o$ are constrained by the equation $\Lambda/X=r_i/r_o$, the foot region of said first leg is adapted to engage the chamber region where the first engagement surface of said heel region engages said first surface of a first fin and said second engagement surface of said toe region of said first foot is adapted to engage the second surface of a second fin to form a sealed operating chamber where rotation of said inner rotor and said outer rotor causes displacement of fluid in the sealed operating chamber, and whereas the casing comprises a gas entrance channel that is adapted to receive a gas and the sealed operating chamber operates as a gas compression chamber that is adapted to compress gas and be discharged through an exit channel, the device further comprising:

a second outer rotor adapted to rotate about a first axis of rotation and the second outer rotor comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

a second set of plurality of inner rotors each adapted to rotate about a second set of axes of rotation and each inner rotor comprising an inner reference circle that is concentric with the axis of rotation of each inner rotor and each inner reference circle intersecting the outer reference circle of said outer rotor at an intersect point where the velocity of the inner rotor and outer rotor are the same at said intersect points, the inner reference circles each having a radius $r_i$, the inner rotors further each comprising a plurality of legs the number of said legs for each inner rotor is indicated by variable Λ where a first leg that is a member of said legs comprises a foot region the foot region comprising;

a heel region comprising a first reference point that is adapted to rotate with said inner reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor; and a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor, where the second expansion device comprises a shaft that is connected to the outer rotor and the second outer rotor where the axis of rotation of the first rotor and second rotor are collinear.

22. The device as recited in claim 21 further comprising: a combustion chamber where air is directed from said exit channel to an inlet region of said combustion chamber, the combustion chamber further comprising an exit passage that is in communication with an expansion passage.

23. The device as recited in claim 22 where the exiting gas from the expansion passage is used for output thrust work.

24. The device as recited in claim 22 where the casing comprises a gas expansion region and a gas inlet port that is in communication with a gas expansion chamber that is defined by first and second surfaces of two adjacent fins and the said first foot where the chamber is adapted to receive expanding gas that applies a torque to the outer rotor.

25. The device as recited in claim 24 where the torque on the outer rotor is used to compress air to feed the said combustor.

26. The device as recited in claim 24 where a portion of the output gas from the combustor is directed to drive an expansion chamber of the said second compression device.

27. A device to convert energy by displacing fluid, the device comprising:

an outer rotor adapted to rotate about a first axis of rotation and comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

an inner rotor adapted to rotate about a second axis of rotation and the inner rotor comprising an inner reference circle that is concentric with the second axis of rotation and the inner reference circle intersecting the outer reference circle of said outer rotor at an intersect point where the velocity of the inner rotor and outer rotor are the same at said intersect points, the inner reference circle having a radius $r_i$, the inner rotor further comprising a plurality of legs the number of said legs for each inner rotor is indicated by variable $\Lambda$ where a first leg that is a member of said legs comprises a foot region the foot region comprising:

a heel region comprising a first reference point that is adapted to rotate with the inner reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor, a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor; and a casing having an inner chamber region that is adapted to house said outer rotor and allow the outer rotor to rotate therein, the casing comprising;

a fluid entrance system comprising a duct to communicate with the chamber region of said outer rotor; and an interior cavity adapted to house said inner rotors and allow the inner rotors to rotate therein, whereas the said variables $\Lambda$, X, $r_i$, $r_o$ are constrained by the equation $\Lambda/X=r_i/r_o$, the foot region of said first leg is adapted to engage the chamber region where the first engagement surface of said heel region engages said first surface of a first fin and said second engagement surface of said toe region of said first foot is adapted to engage the second surface of a second fin to form a sealed operating chamber where rotation of said inner rotor and said outer rotor causes displacement of fluid in the sealed operating chamber;

wherein the casing comprises a gas entrance channel that is adapted to receive a gas and the sealed operating chamber operates as a gas compression chamber that is adapted to compress gas and be discharged through an exit channel;

a second expansion device that comprises:

a second outer rotor adapted to rotate about a first axis of rotation and the second outer rotor comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

an inner rotor adapted to rotate about a second axis of rotation and the inner rotor comprising an inner reference circle that is concentric with the axis of rotation of the inner rotor and the inner reference circle intersecting the outer reference circle of said outer rotor at an intersect point where the velocity of the inner rotor and outer rotor are the same at said intersect points, the inner reference circles each having a radius $r_i$, the inner rotor comprising a plurality of legs the number of said legs for the inner rotor is indicated by variable Λ where a first leg that is a member of said legs comprises a foot region the foot region comprising;

a heel region comprising a first reference point that is adapted to rotate with said inner reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor; and a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor;

a combustion chamber where air is directed from the said exit channel to an inlet region of the said combustion chamber, the combustion chamber further comprising an exit passage that is in communication with an expansion passage;

where the casing comprises a gas expansion region and a gas inlet port that is in communication with a gas expansion chamber that is defined by first and second surfaces of two adjacent fins and the said first foot where the chamber is adapted to receive expanding gas that applies a torque to the outer rotor; and where the torque on the outer rotor is used to compress air to feed the said combustor.

28. The device as recited in claim 27 where said sealed chamber is maintained for five degrees of rotation of the inner rotor.

29. The device as recited in claim 27 where said sealed chamber is maintained for fifteen degrees of rotation of the inner rotor.

30. The device as recited in claim 27 where the outer rotor is adapted to receive torque and said sealed chamber is adapted to compress gas.

31. The device as recited in claim 27 where the tangential distance between said first surface faces second surface of the two adjacent fins converge with respects to the traveling radial inward.

32. The device as recited in claim 27 where the tangential distance between said first surface faces second surface of the two adjacent fins is not constant.

33. A device to convert energy by displacing fluid, the device comprising:

an outer rotor adapted to rotate about a first axis of rotation and comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

an inner rotor adapted to rotate about a second axis of rotation and the inner rotor comprising an inner reference circle that is concentric with the second axis of rotation and the inner reference circle intersecting the outer reference circle of said outer rotor at an intersect point where the velocity of the inner rotor and outer rotor are the same at said intersect points, the inner reference circle having a radius $r_i$, the inner rotor further comprising a plurality of legs the number of said legs for each inner rotor is indicated by variable Λ where a first leg that is a member of said legs comprises a foot region the foot region comprising:

a heel region comprising a first reference point that is adapted to rotate with the inner reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor, a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor; and a casing having an inner chamber region that is adapted to house said outer rotor and allow the outer rotor to rotate therein, the casing comprising;

a fluid entrance system comprising a duct to communicate with the chamber region of said outer rotor; and an interior cavity adapted to house said inner rotors and allow the inner rotors to rotate therein, whereas the said variables Λ, X, $r_i$, $r_o$ are constrained by the equation $\Lambda/X=r_i/r_o$, the foot region of said first leg is adapted to engage the chamber region where the first engagement surface of said heel region engages said first surface of a first fin and said second engagement surface of said toe region of said first foot is adapted to engage the second surface of a second fin to form a sealed operating chamber where rotation of said inner rotor and said outer rotor causes displacement of fluid in the sealed operating chamber;

wherein the casing comprises a gas entrance channel that is adapted to receive a gas and the sealed operating chamber operates as a gas compression chamber that is adapted to compress gas and be discharged through an exit channel;

a second expansion device that comprises:

a second outer rotor adapted to rotate about a first axis of rotation and the second outer rotor comprising:

a plurality of fins each comprising a first surface and a second surface that partially define a chamber region interposed thereinbetween where a first fin and a second fin are members of said plurality of fins and are adjacent to each other, a first reference radius extends through the first fin and a second reference radius extends through the second fin, a first surface of said first fin is a first defined distance from said first reference radius with respects to the radial location along said first reference radius, and a second surface of said second fin is a second defined distance from said second reference radius with respects to the radial location along said second reference radius, the number of the chambers indicated by variable X, and an outer reference dimension circle that is concentric with said first axis of rotation of said outer rotor and the outer reference dimension circle having a radius $r_o$;

a second inner rotor adapted to rotate about a second axis of rotation and the second inner rotor comprising an inner reference circle that is concentric with the axis of rotation of the inner rotor and the inner reference circle intersecting the outer reference circle of said outer rotor at an intersect point where the velocity of the inner rotor and outer rotor are the same at said intersect points, the inner reference circles each having a radius $r_i$, the inner rotor further each comprising a plurality of legs the number of said legs for the inner rotor is indicated by variable Λ where a first leg that is a member of said legs comprises a foot region the foot region comprising;

a heel region comprising a first reference point that is adapted to rotate with said inner reference circle where said first reference point is non constant perpendicular distance from said first reference radius of the outer reference circle with respects to rotation of the inner and the outer rotor, and the heel region further comprising a first engagement surface that is a first defined distance from said first point where said first defined distance of the heel region and the first defined distance of the first surface of said first fin are collinear and their sum is non constant with respects to rotation of the inner rotor and the outer rotor; and a toe region comprising a second reference point that is positioned on said inner reference dimension circle, a second engagement surface that is a second defined distance from the reference point where the second defined distance of the toe region and the second defined distance of the second surface of the second fin are collinear and their sum is non constant with respects to rotation of the inner rotor and outer rotor;

a combustion chamber where air is directed from the said exit channel to an inlet region of the said combustion chamber, the combustion chamber further comprising an exit passage that is in communication with an expansion passage;

where the casing comprises a gas expansion region and a gas inlet port that is in communication with a gas expansion chamber that is defined by first and second surfaces of two adjacent fins and the said first foot where the chamber is adapted to receive expanding gas that applies a torque to the outer rotor; and where a portion of the output gas from the combustion chamber is directed to drive an expansion chamber of said second compression device.

* * * * *